US006196741B1

(12) United States Patent
Koshi et al.

(10) Patent No.: US 6,196,741 B1
(45) Date of Patent: Mar. 6, 2001

(54) PRINTER

(75) Inventors: Kazumine Koshi, Hirakata; Noriyuki Saito, Sanda; Tohru Arakawa, Nishinomiya; Masaaki Matsui, Hirakata; Toshio Tanaka, Kyotanabe, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/230,568

(22) PCT Filed: May 27, 1998

(86) PCT No.: PCT/JP98/02311

§ 371 Date: Nov. 29, 1999

§ 102(e) Date: Nov. 29, 1999

(87) PCT Pub. No.: WO98/54078

PCT Pub. Date: Dec. 3, 1998

(30) Foreign Application Priority Data

May 28, 1997 (JP) ..... 9-138110
Jul. 11, 1997 (JP) ..... 9-186330
Feb. 16, 1998 (JP) ..... 10-032460

(51) Int. Cl.[7] ..... B41J 11/26
(52) U.S. Cl. ..... 400/621; 400/613; 400/642
(58) Field of Search ..... 400/613, 621, 400/611, 642

(56) References Cited

U.S. PATENT DOCUMENTS 3,276,559 * 10/1966 De Man ..... 400/613
3,277,992 * 10/1966 Bremer ..... 400/613
3,366,212 * 1/1968 McInnis ..... 400/613
3,593,833 * 7/1971 Bretti ..... 400/613
4,097,147 6/1978 Portewig .
4,860,031 8/1989 Lejcek .
5,201,588 * 4/1993 Sakai et al. ..... 400/613
5,276,527 * 1/1994 Sugiyama et al. ..... 400/613
5,407,115 4/1995 Blalock et al. .
5,411,342 5/1995 Horie et al. .
5,478,161 * 12/1995 Suzuki et al. ..... 400/621

* cited by examiner

*Primary Examiner*—Eugene Eickholt
(74) *Attorney, Agent, or Firm*—Wenderoth, Lind & Ponack, L.L.P.

(57) ABSTRACT

The present invention aims at providing a printing apparatus of a small size that facilitates replacement of a rolled paper, removal of a jammed paper, etc. and alleviates likeliness of a paper jam with a considerably simple structure. The printing apparatus comprises a rolled-paper holder (2), which is provided with a first holder (2*b*) for use in carrying out printing on a rolled paper (1), and a second holder (2*a*) for use in setting the rolled paper (1), wherein the rolled paper (1) is moved from the second holder (2*a*) to the first holder (2*b*) as a main body of the apparatus is shifted from a paper setting position to a printing work position, thereby facilitating the setting of the rolled paper (1) and removal of a jammed paper, since the rolled paper (1) can be temporarily supported by the second holder (2*a*) in order to provide a sufficient work space when replacing the rolled paper (1) or removing a jammed paper.

24 Claims, 25 Drawing Sheets

PRINTER

FIELD OF THE INVENTION

The present invention relates to a printing apparatus for printing characters or figures on a rolled paper by using a printer head, and, more particularly, to a printing apparatus having a considerably simple structure, for which replacement of the rolled paper and removal of a jammed paper can be carried out easily, while decreasing incidents of paper jam.

BACKGROUND OF THE INVENTION

In general, most of known printing apparatus of the kind have been such that a printed output is of a definite format, and, upon completion of printing, it generally sends out the printed output with a paper transfer mechanism in a manner that a perforated line of a recording paper comes out of the apparatus, allowing the printed output to be cut along the perforated line.

Accordingly, some apparatus have been proposed in recent yeas, in which a printed output is transferred to a discharge port by using a transfer means, etc. after it is cut while the printing is stopped for a moment within the apparatus, as shown in FIG. 26, in order to adapt printed output of an irregular shape (varied in length) and to avoid paper jams due to a consequent strain of the recording paper during the printing.

That is, a numeral 51 in the figure represents a rolled paper, which is so arranged that it is cut in a predetermined length by a cutter unit 53, and transferred to a discharge port 55 by a presenter 54 after it is printed with a printer unit 52. Also, a numeral 56 represents a rolled-paper holder for supporting the rolled paper 51 rotatably, and numerals 57 and 58 are a roller and a printer head respectively, as they represent structural elements of the printer unit 52.

With the above described structure of the prior art, a leading end of the rolled paper 51 held in the rolled-paper holder 56 needs to be inserted into a feeding port (not shown in the figure) of the printer unit 52 when the rolled paper 51 is reset in the printer unit 52 for replacement of the rolled paper 51, or after removal of a jammed paper, etc. In doing this task, however, the leading edge of the rolled paper 51 held in the rolled paper holder 56 can not be inserted simply and easily into the feeding port of the printer unit 52, and the jammed paper occurred between the rolled paper 51 and the printer unit 52 can not be readily removed because of a very tight space between the rolled paper 51 and the printer unit 52 in the previous structure.

There has been a fear that the rolled paper 51 is inadvertently rumpled or torn, if the rolled paper 51 could not be set easily in position. Also, there has been another fear that a part of the jammed paper is left behind in the printing apparatus, if the jammed paper can not be removed easily. They have been a cause to lead another paper jam again. Widening the space between the rolled paper 51 and the printer unit 52 could clear this problem, but it would raise a new problem in which a dimensional reduction of the apparatus is restricted.

Also, the structure of the prior art has frequently caused paper jams in the transfer means 54. Although there is a way to prevent it, in that the transfer means 54 is disused, and recording papers are freely dropped with their own weight, leading them to the discharge opening after printing, it poses a problem with the papers that fly out of the discharge opening by an impetus of the dropping.

Furthermore, the structure of the prior art tends to cause the rolled paper 51 to stick with a surface of the roller 57 or the printer head 58 during a long stand-by time, or if it is used in an environment of high temperature, high humidity, low temperature, low humidity, etc. regardless of the stand-by period, so as to result in a failure-of feeding the paper in the succeeding printing operation and to become liable to cause a paper jam. Also, there have been cases in which the paper transferring operation is impaired due to oxidation, corrosion, hardening of grease, etc. of components such as a gear, an axle, a bearing, etc. that constitute a paper transfer mechanism. There have also been impairments with an operation of a cutter mechanism having a similar component structure.

The present invention is intended to solve the above problems, and it aims at providing a printing apparatus of a small size that facilitates replacement of a rolled paper, removal of jammed papers, etc. with a considerably simple structure.

The invention also aims at providing a printing apparatus of considerably simple structure that reliably delivers a printed output to a discharge port without causing a paper jam, even for the printed output of an irregular shape (varied in length).

The invention further aims at providing a highly reliable printing apparatus, which prevents a paper jam in a succeeding printing operation, and avoids an impairment to operation of the paper transfer mechanism and the cutter mechanism, even under such severe conditions as an extended stand-by time and use environment of high temperature, high humidity, low temperature, low humidity, etc.

SUMMARY OF THE INVENTION

A printing apparatus of the present invention comprises a rolled-paper holder for supporting a rolled paper, which is provided with a first holder for use in carrying out printing on the rolled paper, and a second holder for use in setting the rolled paper, wherein the rolled paper is moved from the second holder to the first holder on the rolled-paper holder, as a main body of the apparatus is shifted from a position for carrying out the setting work ("paper setting position") to a position for the printing operation ("printing work position"). The above structure provides the apparatus with an effect of facilitating the setting of a rolled paper and removal of jammed papers, and prevents a paper jam, since it is provided with a holder for temporarily holding the rolled paper when the rolled paper is reset or when the rolled paper is provisionally evacuated for replacement of the rolled paper or removal of jammed papers, etc.

Also, the printing apparatus of the present invention comprises a printer unit for printing on the rolled paper, a cutter unit for cutting the rolled paper according to a printed length on the rolled paper, and an L-shaped guide unit for leading the cut paper toward a discharge port by letting the paper to fall with its own weight, and that the discharge port is provided with a stopper for preventing the cut paper from flying out, and a projection on a ceiling portion deep in the discharge port. This enables the structure to disuse a transfer means and to prevent paper jams, because of an effect of the stopper and the projection that can positively prevent the cut paper from flying out, even when the printed output is of an irregular shape (varied in length).

Moreover, the printing apparatus of the present invention is designed to move the recording paper toward a reverse direction after it be once moved toward a forward direction, and to drive the cutter, when a predetermined time is elapsed during a stand-by period. This effectively avoids the recording paper from being stuck completely with the roller or the printer head by temporarily freeing the paper which begins to stick, and, at the same time, prevents component parts of a paper transfer mechanism and a cutter mechanism from oxidation, corrosion, hardening of grease, etc., so as to avoid a paper jam.

DESCRIPTION OF THE PREFERRED EMBODIMENTS

The present invention is described in more detail according to the accompanied drawings.

First Exemplary Embodiment

Figure 1:
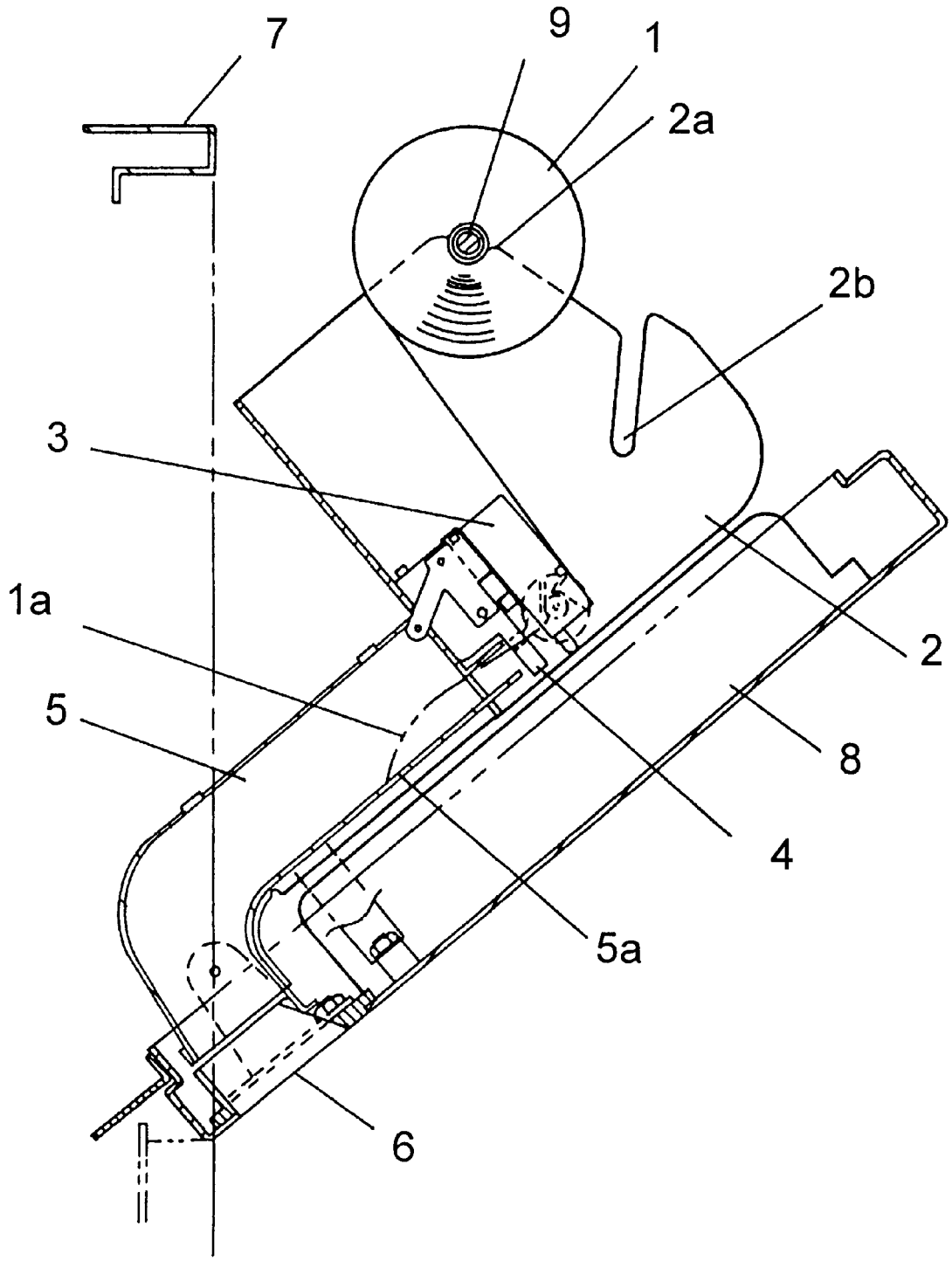
FIG. 1 PRIOR ART
FIG. 1 is a structural drawing depicting a brief construction of a printing apparatus of a first exemplary embodiment of the present invention in its open position for a setting work.
Figure 2:
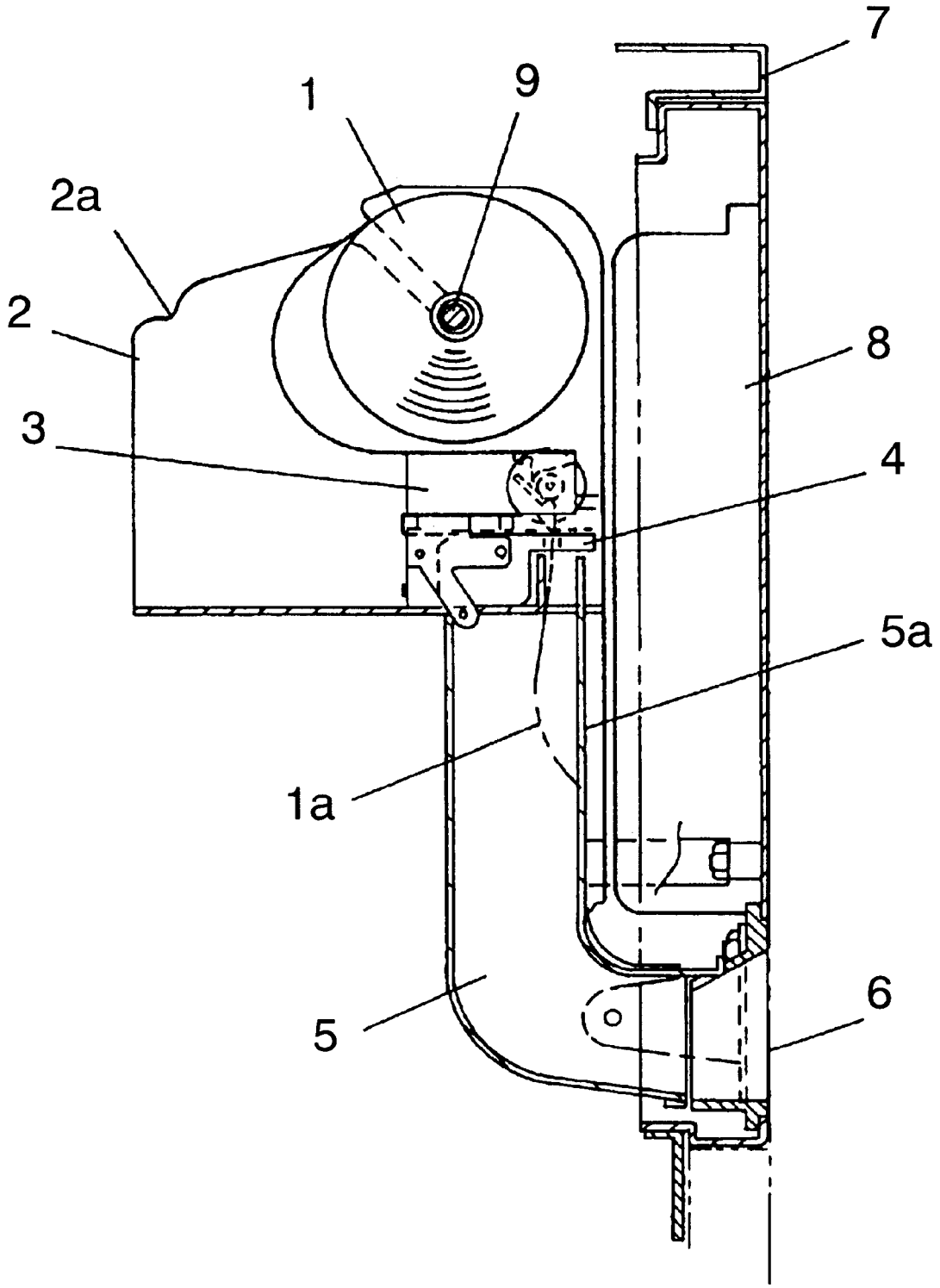
FIG. 2 is a structural drawing depicting a brief construction of the same exemplary embodiment in its closed position for the normal printing operation.
Figure 3B:
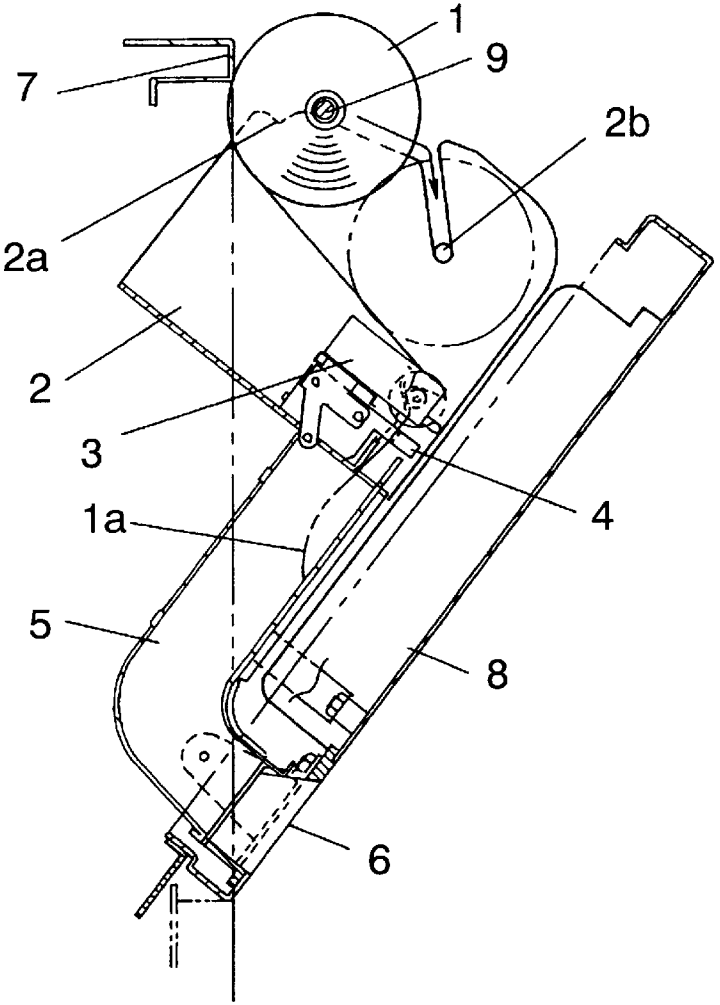
FIG. 3A and FIG. 3B is a structural drawing depicting a brief construction of the same exemplary embodiment in its intermediate position.
Figure 3A:
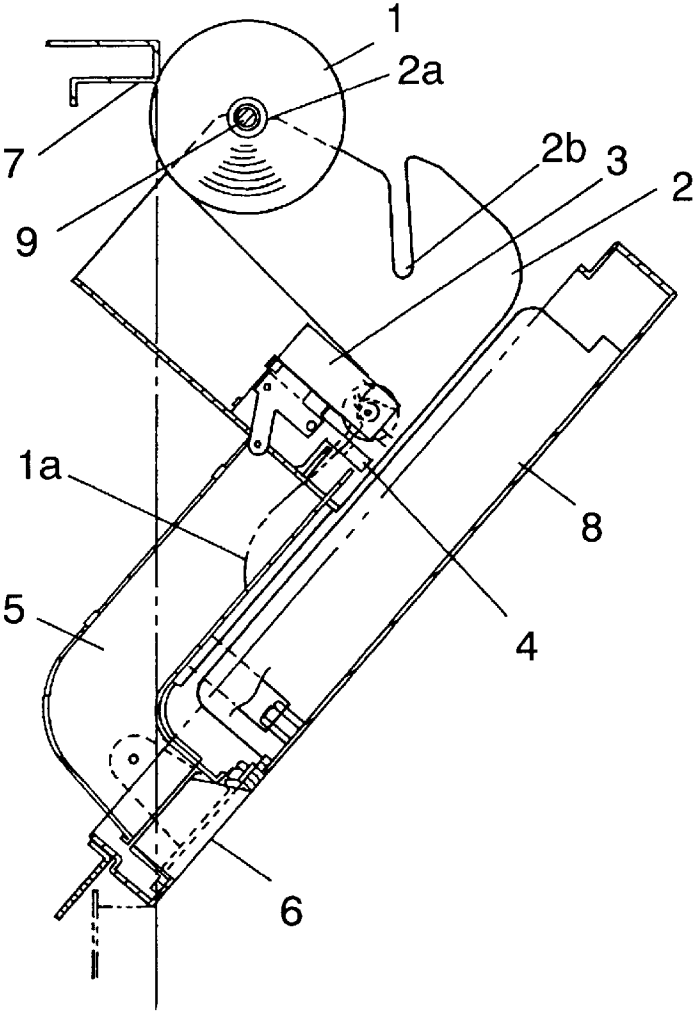

FIG. 1 to FIG. 3B depict a brief structure of a printing apparatus of a first exemplary embodiment of the present invention, where FIG. 1 shows a main body of the apparatus in its open position, FIG. 2 shows the same in its closed position, and FIG. 3A to FIG. 3B shows an intermediate position of the same.

In the figures, a numeral 1 represents a rolled paper, which is axially supported by a roller shaft 9 as well as a rolled-paper holder 2 provided on a back surface of the main body of the apparatus, and it is discharged via a cutter unit 4 after having been printed with a printer unit 3. Also, a recording paper 1*a* cut by the cutter unit 4 in a predetermined length falls toward a discharge port 6 through a guide unit 5 having a shape of duct.

The rolled-paper holder 2 is provided with a first holder 2*b* for securely supporting the rolled paper 1 while carrying out printing on the rolled paper 1, and a second holder 2*a* for temporarily supporting the rolled paper 1 when the rolled paper 1 is replaced or a jammed paper is removed, wherein the rolled paper 1 is rotationally or slidingly moved from the second holder 2*a* to the first holder 2*b* by a rolled-paper thruster 7 provided on a part of a housing for storing the main body of the apparatus, along with a movement of the main body being stored into the housing.

Incidentally, a numeral 8 is a controller composed of a touch panel, a key switch, etc., and a printing operation on the rolled paper 1 is carried out in response to a command of the controller 8.

An operation of the printing apparatus composed of the above structure is now described by referring to FIG. 1 to FIG. 3B. As shown in FIG. 1, a large space can be provided for replacement of the rolled paper 1 or removal of a jammed paper, if the rolled paper 1 is positioned temporarily on the second holder 2*a* of the rolled-paper holder 2, so as to allow the work to be carried out very easily when inserting a leading end of the rolled paper 1 into a feeding port (not shown in the figure) of the printer unit 3, or removing the jammed paper in the printer unit 3. Also, when the rolled paper 1 is held on the first holder 2*b* of the rolled-paper holder 2 with the main body of the apparatus returned to the normal printing work position, as shown in FIG. 2, a space between the rolled paper 1 and the printer unit 3 is reduced substantially, since replacement of the rolled paper 1 or removal of the jammed paper need not be carried out in this position, so that a reduction in size is realized of a printer unit portion composed of the rolled-paper holder 2, the printer unit 3, the cutter unit 4, etc.

Furthermore, as shown in FIG. 3A and FIG. 3B, the rolled paper 1 positioned temporarily on the second holder 2*a* of the rolled-paper holder 2 makes a contact with the rolled-paper thruster 7 (FIG. 3A) when the main body of the apparatus is shifted from the paper setting position for the rolled paper toward the normal printing work position, and the rolled paper 1 is disengaged from the second holder 2*a* to rotationally or slidingly move to the first holder 2*b* along a sloped edge of the rolled-paper holder 2 (FIG. 3B) when the main body is further shifted, so that the rolled paper 1 can be restored into the position for carrying out printing with a simple return of the main body to the original position, thereby enabling a replacement of the rolled paper 1 and removal of jammed paper easily and in a short time. Hence, the above structure can prevent a paper jam caused by a working error during replacement of the rolled paper 1 and an incomplete removal of papers jammed in and around the printer unit.

Although in the present embodiment the main body of the apparatus is constructed so as to be openable on an axis at its lower end, this is not exclusive and the same effect is attainable by constructing it to be openable on an axis located at an upper end or at an either side of right or left side of the upper end. Also the present embodiment can take up a slack of the rolled paper 1, because a rotating direction and a moving direction of the rolled paper 1 in its rotational movement from the paper setting position to the printing work position are in a relationship of rewinding the rolled paper 1.

Second Exemplary Embodiment

Figure 4:
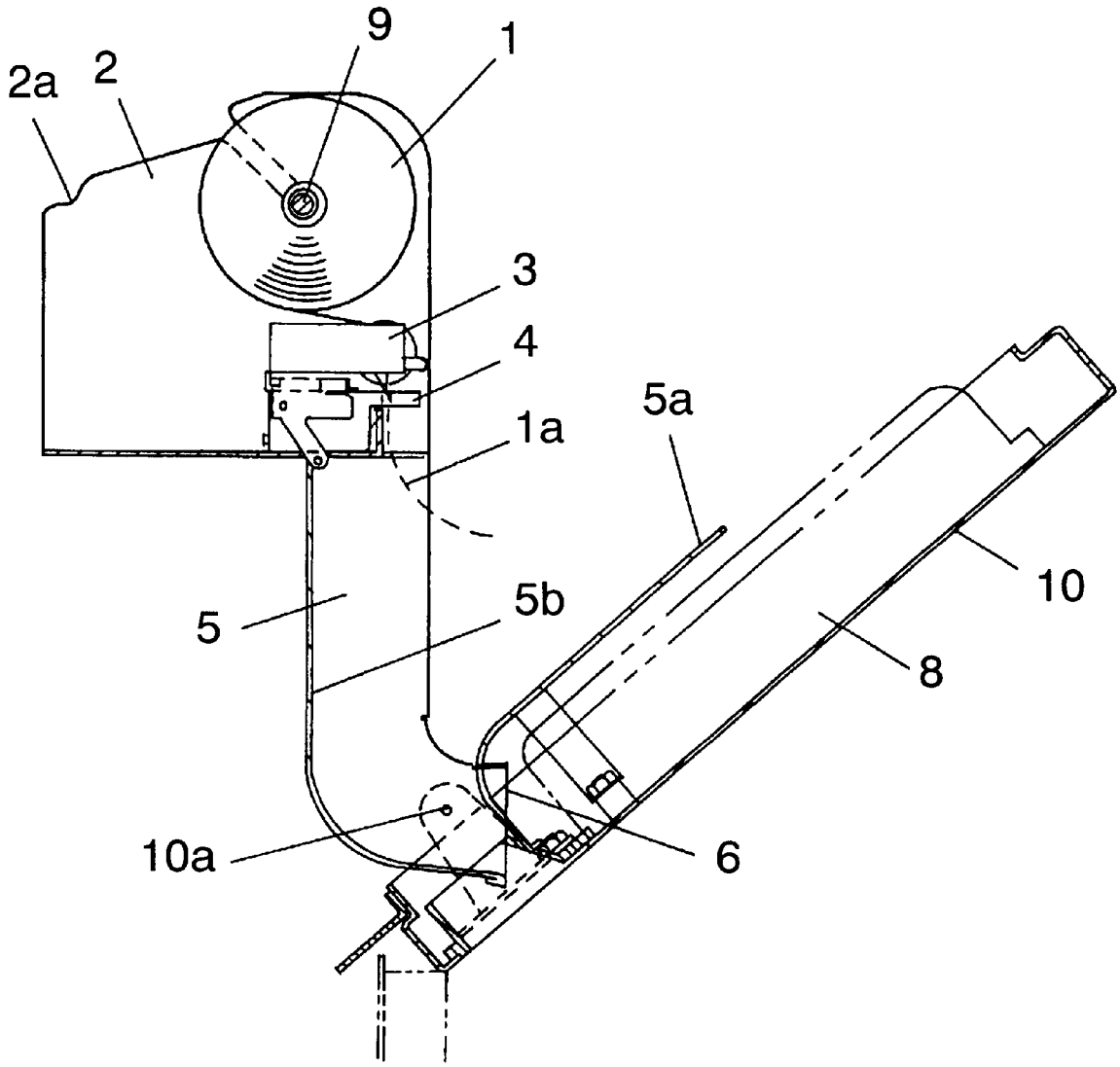
FIG. 4 is a structural drawing depicting a brief construction of a printing apparatus of a second exemplary embodiment of the present invention.

FIG. 4 depicts a structure of a printing apparatus of a second exemplary embodiment of the present invention. Any components having the same structure as the first exemplary embodiment are assigned with the same reference numerals and their descriptions are omitted.

In the figure, a guide unit 5 in a shape of duct comprises a first guide member 5*a*, which is attached onto a back surface of a cover 10 provided to cover a part of or the entirety of a main body of the apparatus, and a second guide member 5*b*, which is provided on the main part of the apparatus, wherein closing the cover 10 by revolving it on an axis 10*a* composes the guide unit 5 in a shape of duct.

Also, since a printed paper 1*a* touches at its leading end with the first guide member 5*a* provided on the back surface of the cover 10, at most of the time, as the rolled paper 1 is supported on the rolled-paper holder 2 in a manner that it is touched with a curled end toward the cover side, a paper jam due to the recording paper 1*a* being caught at its leading end is prevented by smoothing a surface roughness of the first guide member 5*a*, or by reducing a contact area with a provision of a plurality of ribs, or by using an electrically conductive material such as metal, etc. to discharge static electricity charged in the recording paper 1*a*.

With the above-described structure, the recording paper 1*a* can be smoothly and positively taken out of the discharge port 6, a jammed paper can be easily and positively removed, if it ever occurs, by simply opening the cover 10, and a paper jam due to an incomplete removal of jammed papers is prevented.

Although in the described embodiment the cover is constructed so as to be openable on an axis at its lower end, this is not exclusive and the same effect is attainable by constructing it to be openable on an axis located at an upper end or at an either side of right or left side of the upper end.

Third Exemplary Embodiment

Figure 5:
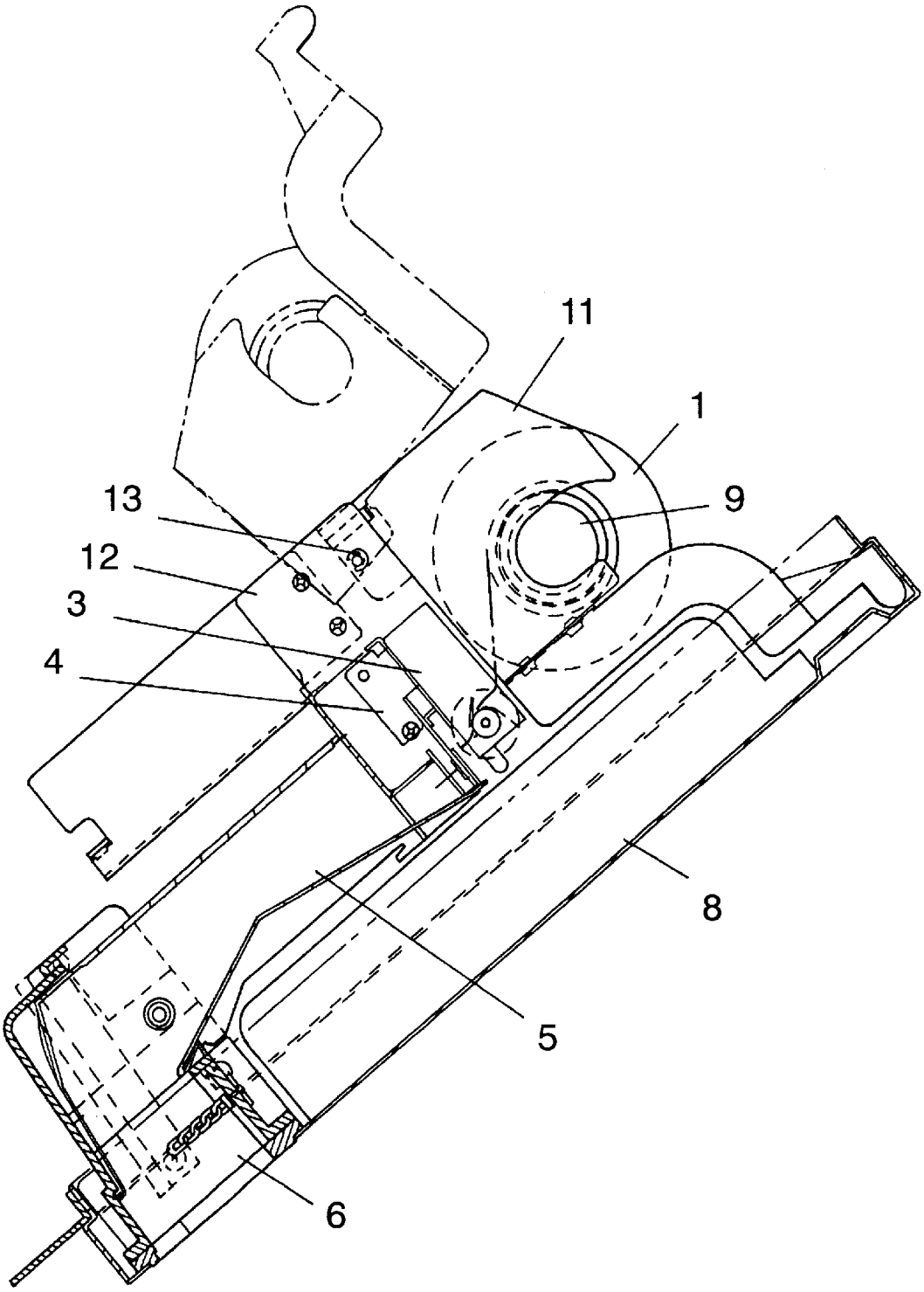
FIG. 5 is a structural drawing depicting a brief construction of a printing apparatus of a third exemplary embodiment of the present invention in a position for a setting work.

FIG. 5 is a brief structural drawing of a printing apparatus of a third exemplary embodiment of the present invention, showing a main body of the apparatus in its open position. Any components having the same structure as the second exemplary embodiment are assigned with the same reference numerals and their descriptions are omitted.

A numeral 11 represents a movable rolled-paper holder for rotatably supporting a roller shaft 9 of the rolled paper 1. A numeral 12 represents a frame for supporting a printer unit 3, cutter unit 4 and a guide unit 5. A numeral 13 represents a shaft attached to the frame 12 while supporting the movable rolled-paper holder 11. Accordingly, the movable rolled-paper holder 11 is rotatably attached to the frame 12 with the shaft 13 as an axis of rotation.

A figure depicting the movable rolled-paper holder 11 by a chain double-dashed line represents the movable rolled-paper holder 11 in a position for setting the rolled paper 1, or a second position, and a figure depicted by a continuous line represents a first position for printing on the rolled paper 1. The rolled paper 1 can be easily replaced when the movable rolled-paper holder 11 is in the second position, since a large space is made available over the printer unit 3 in the same way as in FIG. 1 for the first exemplary embodiment.

When carrying out printing on the rolled paper 1, the movable rolled-paper holder 11 is moved manually from the second position to the first position, or, as an alternate way, the movable rolled-paper holder 11 may be moved from the second position to the first position along with a movement of the main body from an open position to a closed position by providing a rolled-paper thruster 7 (not shown in FIG. 4).

While the roller shaft 9 is made of a material in a shape of cylinder or tube, it can be a cause of paper jams if the diameter is small, because the rolled paper is habituated to a curly paper. If the diameter is large, on the contrary, it forces to increase a size of the apparatus as the rolled paper 1 also increases in diameter. An appropriate diameter shall be 15 mm or larger, and preferably between 35 mm to 40 mm to prevent a habitual curly paper.

Fourth Exemplary Embodiment

A fourth exemplary embodiment of the present invention is described by referring to FIG. 6 to FIG. 9C.

Figure 6:
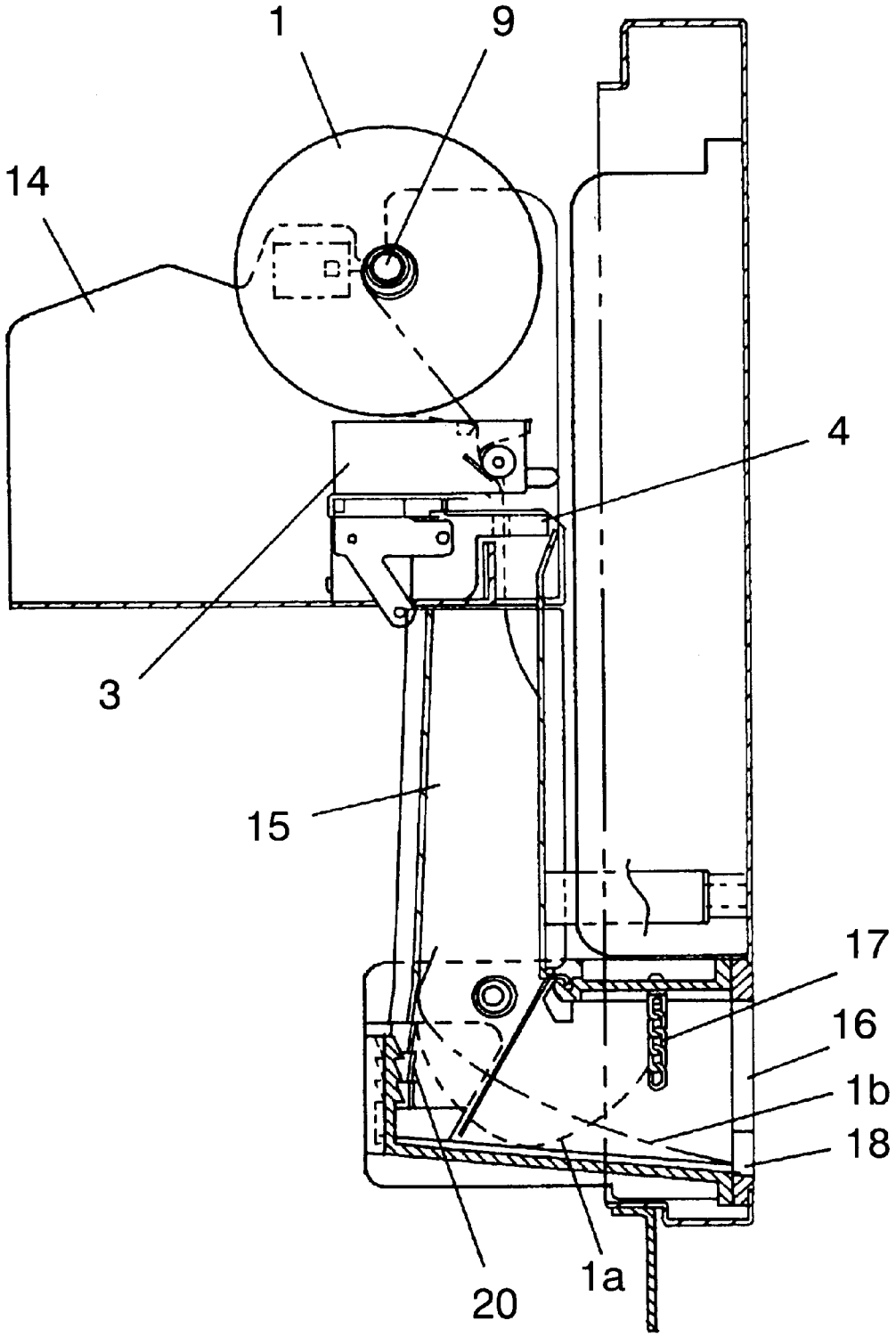
FIG. 6 is a structural drawing depicting a brief construction of a printing apparatus of a fourth exemplary embodiment of the present invention.
Figure 7:
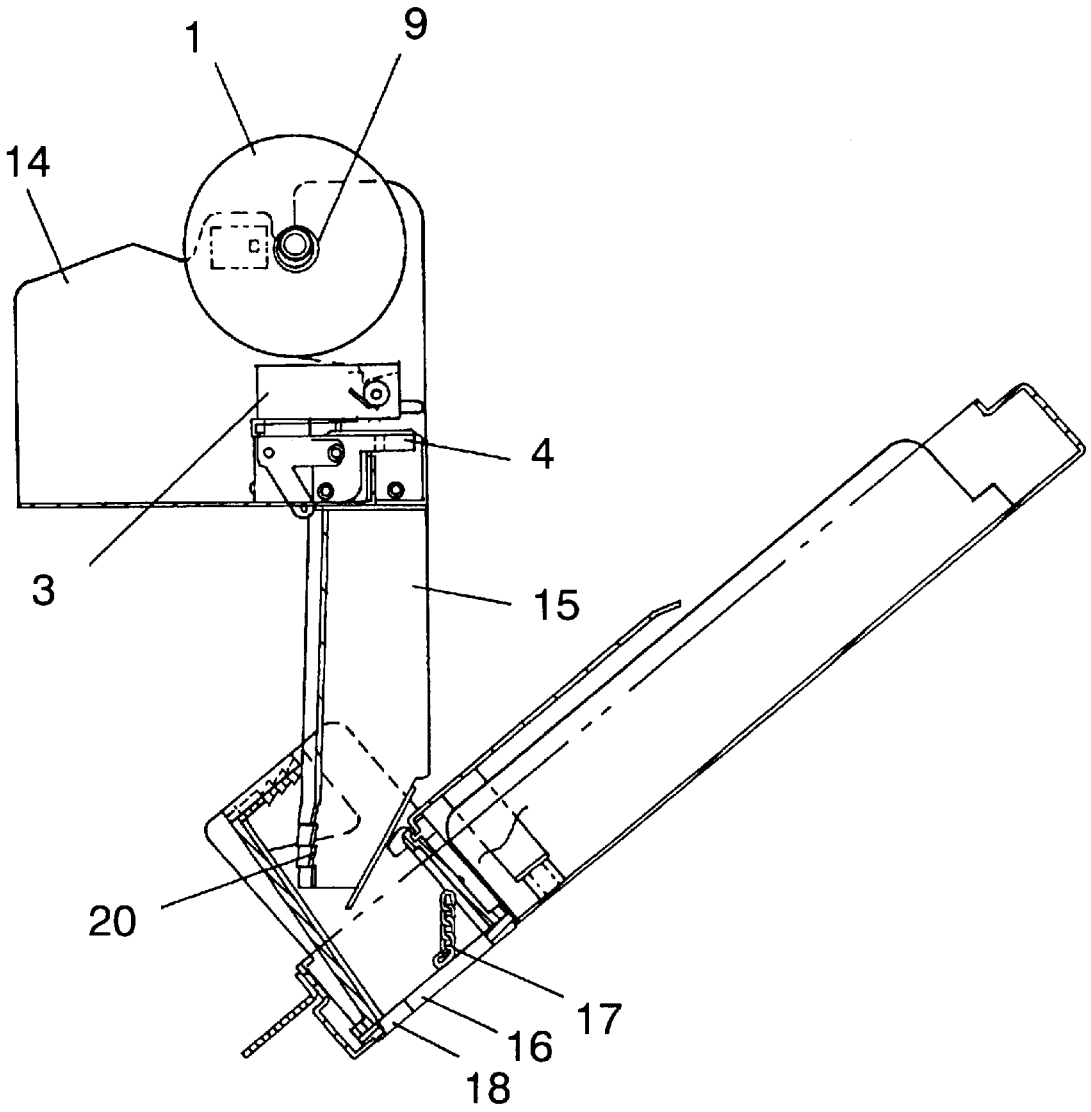
FIG. 7 is a structural drawing depicting a main body of the apparatus of the same exemplary embodiment in its open position.
Figure 8:
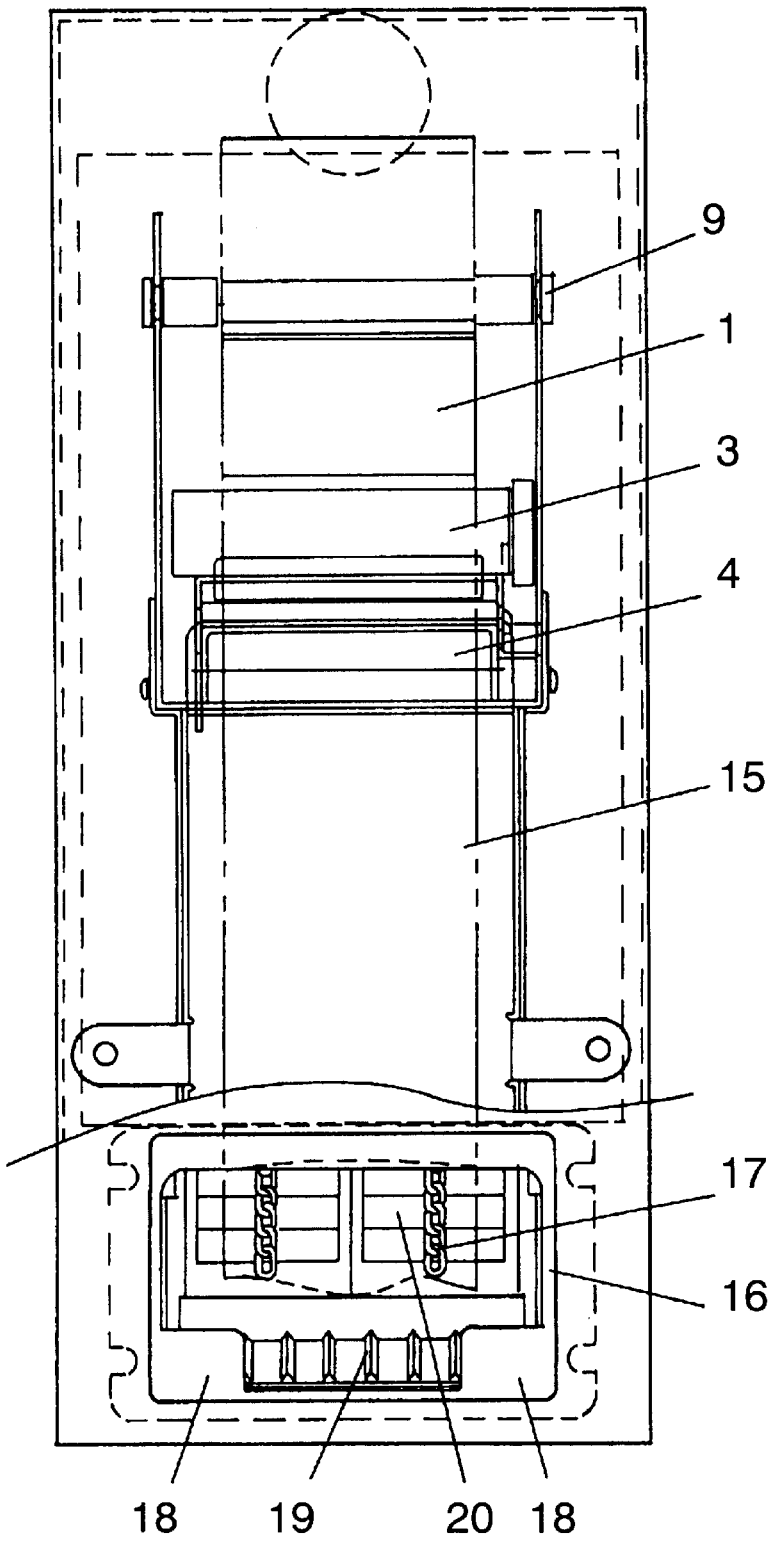
FIG. 8 is a partially sectioned front view of the main body of the apparatus of the same exemplary embodiment, as observed at the front.
Figures 9A, 9B, 9C:
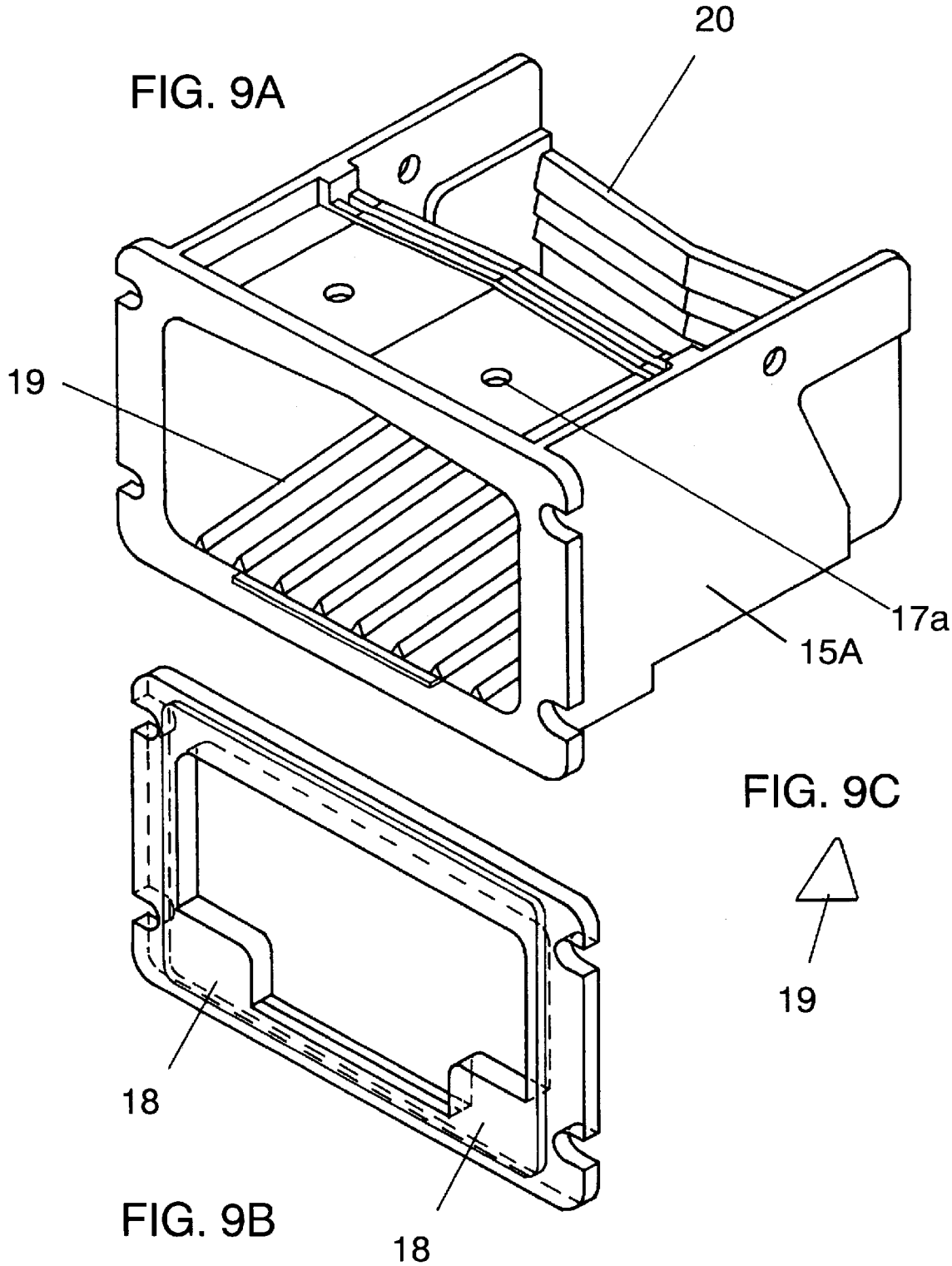
FIG. 9A to FIG. 9C is a structural drawing depicting a construction of a discharge port of the same exemplary embodiment.

FIG. 6 is a structural drawing depicting a brief construction of a printing apparatus of the fourth exemplary embodiment of the present invention, FIG. 7 is a structural drawing depicting a main body of the apparatus in its open position, FIG. 8 is a partially sectioned front view as observed at the front, and FIG. 9A to FIG. 9C are a structural drawings depicting a construction of a discharge port.

In FIG. 6, a numeral 1 represents a rolled paper, which is axially supported by a roller shaft 9 as well as a rolled-paper holder 14 provided on a back surface of a main body of the apparatus, and it is cut by a cutter unit 4 according to a printed length, after having been printed with a printer unit 3. Also, printed recording papers 1*a* and 1*b* cut by the cutter unit 4 according to the printed length are led toward a discharge port 16 with their own weights by passing through an L-shaped guide unit 15 in a form of duct. FIG. 7 depicts the main body of the apparatus with its backside in an open position, as it is integrally constructed to be rotatable by the rolled-paper holder 14 and a part of the L-shaped guide unit 15 as one piece.

Two links of chain 17 are hung as projections from a ceiling surface of the L-shaped guide unit 15 in the vicinity of its distal end, so that when a piece of paper in a shape depicted as a recording paper 1*a*, which is viciously curled as it has been rolled in a center part of the rolled paper 1, falls down, it is prevented from flying out of a discharge port 16 as it is caught by the chain links 17. Since these chain links 17 are shaped like a bead curtain as in FIG. 8 when viewed at the front, an inside of the discharge port 16 is readily-observable to find a presence of printed output at a glance, and the printed output is easily pulled out by inserting a hand without an obstruction to the printed output.

The projection can be a cord-like, a belt-like object or a stick-shaped object being hung down, instead of the chain links 17, as a matter of course, in order to attain the same effect. Also, the chain links 17 may be positioned as deep inside of the discharge port 16 as possible within a boundary of maintaining the functional effect as a stopper, and shorten a length at the same time in order to prevent a damage due to mischievous haul of the chain links 17. Furthermore, the chain links 17 are preferably made of electrically conductive material in a viewpoint of avoiding clinging between the recording papers 1*a* and 1*b* due to static electricity.

Next, the discharge port 16 is provided with a stopper 18, and when a piece of paper in a shape as shown by a recording paper 1*b*, which is slightly curled as it has been rolled in an outer part of the rolled paper 1, falls down, it is prevented from flying out of the discharge port 16 as it is caught by the stopper 18. Also, the stopper 18 is constructed to have projections at both sides of the discharge port 16 in a manner to provide a wide opening at a center and the vicinity, as shown in FIG. 8 and FIG. 9A to FIG. 9C.

With the simple structure as described above, the chain links 17 or the stopper 18 can positively prevent the recording papers 1*a* and 1*b* from flying out, even if the printed output is of an irregular shape (varied in length). In this way, a printing apparatus can be constituted without employing a transfer means of the prior art, to be capable of preventing paper jams, so as to realize a simplified apparatus.

An end part 15A of the L-shaped guide unit 15 is provided on its bottom surface with a plurality of ribs 19 in a triangular shape at the tips, and the entire bottom surface is inclined toward the discharge port 16 side, with its lowest part located at nearly equal to or slightly higher than a center area of the discharge port 16, so that a drop of water entered inside due to condensation, rain, washing, etc. is led along the slope on the bottom surface, and collected water is drained through the center area of the discharge port 16. A numeral 17*a* represents a hole for mounting a chain link 17 on the end part 15A.

The bottom surface may be provided with a channel or a hole for drainage at a lowermost location to discharge the collected water outside, and the stopper 18 can be provided also at a center area of the discharge port 16 in that case. Since the rib 19 is formed in a triangular shape and asymmetrical, as shown in FIG. 9C, it casts balance of the water drop to avert it from remaining on the tip of the rib 19, whereas a water drop tends to stay on the tip of the rib 19 due to the surface tension if it is symmetrical. Thus, it can quickly reinstate a condition of no water drop remaining on at least the tip of the rib 19, even if water gets inside by the rain, washing, etc., so as to avoid wetting of the printed output and paper jams due to the wet paper.

Furthermore, a back surface of the end part 15A of the L-shaped guide unit 15 is provided with a plurality of ribs 20 in a direction generally perpendicular to the discharge direction of paper, as shown in FIG. 9A, with their tips sloped toward the bottom surface side, and all of the ribs 20 are laterally inclined from an approximate center of the back surface in a direction of the breadth, so that they disperse water entered inside both downward and laterally, and prevent the water from spattering upward in the L-shaped guide unit 15. This enables the apparatus to be used outdoors.

Fifth Exemplary Embodiment

Figure 10:
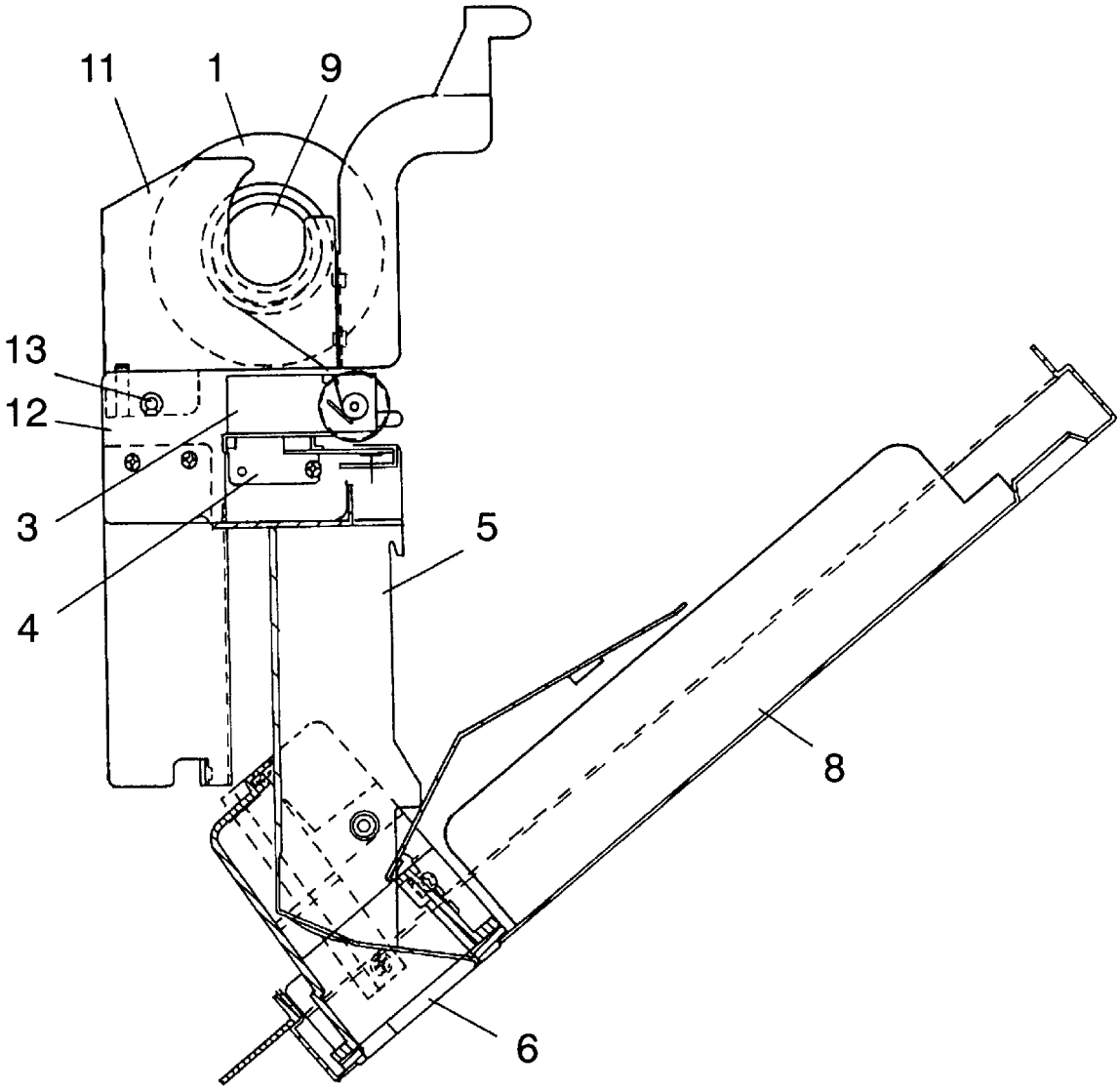
FIG. 10 is a structural drawing depicting a brief construction of a printing apparatus of a fifth exemplary embodiment of the present invention.
Figure 11:
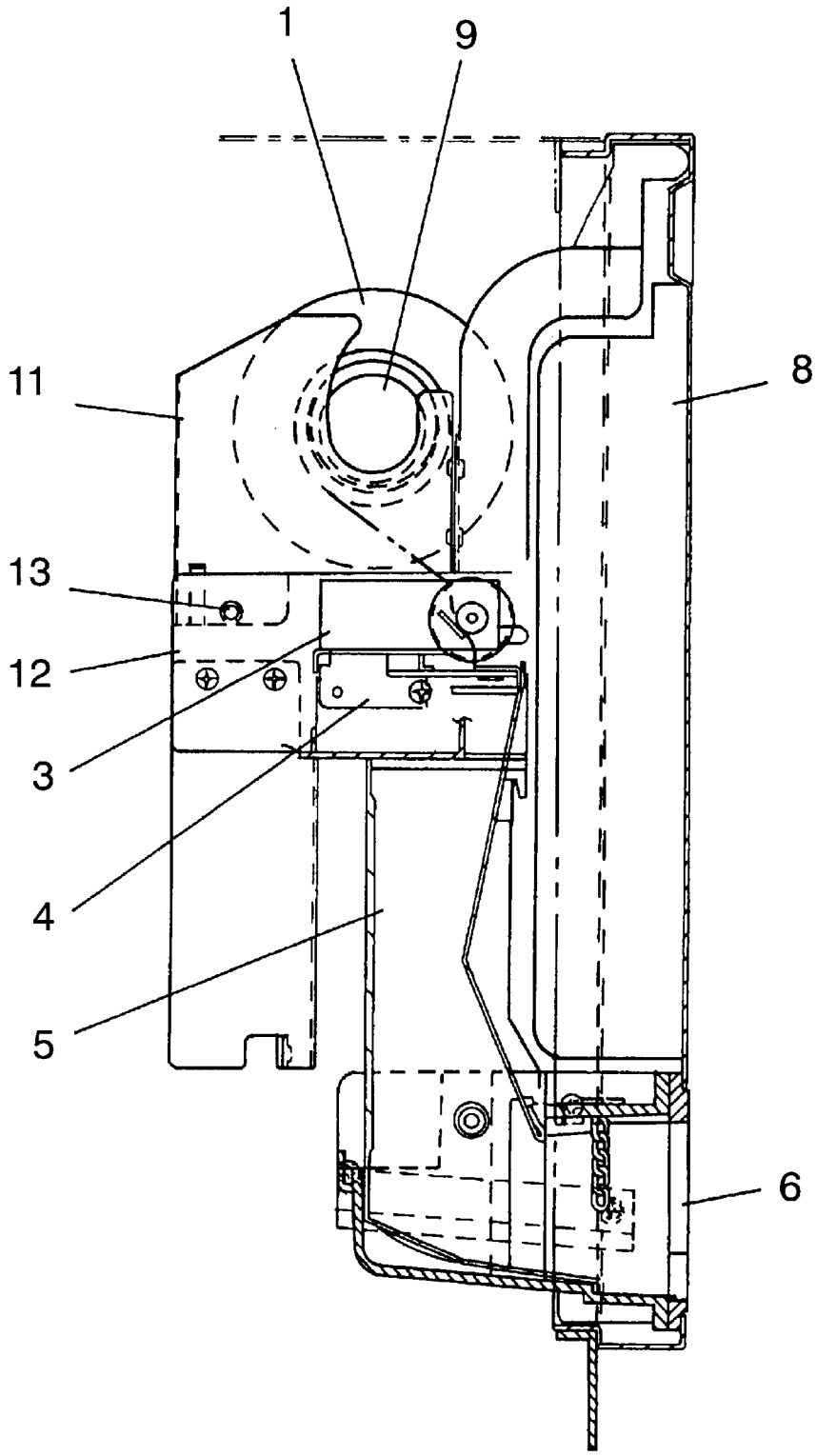
FIG. 11 is a side view of the same exemplary embodiment.
Figure 12:
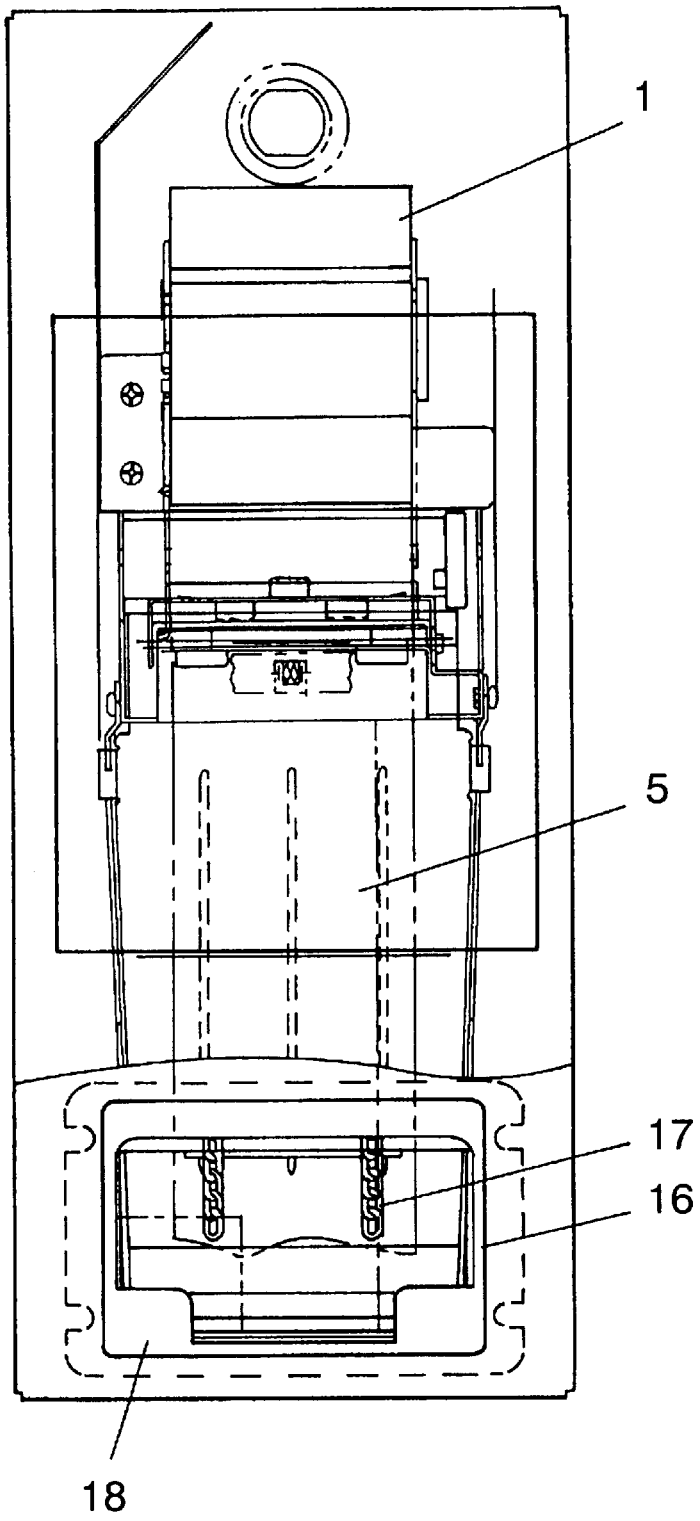
FIG. 12 is a front view of the same exemplary embodiment.

A fifth exemplary embodiment is described by referring to FIG. 10 to FIG. 12.

FIG. 10 is a structural drawing depicting a printing apparatus of the fourth exemplary embodiment of the present invention in its open position, FIG. 11 depicts a side view, and FIG. 12 is a partially sectioned drawing as viewed at the front. Since the present embodiment is similar to the third exemplary embodiment, any components of the same structure are assigned with the same reference numerals and their descriptions are omitted. Also, those components assigned with numerals 16, 17 and 18 have the same structures as the fourth exemplary embodiment.

The above structure can also alleviate paper jams and prevent the recording papers 1*a* and 1*b* from flying out of a discharge port 16, in the same way as the fourth exemplary embodiment. And, removal of a jammed paper is easy, as shown in FIG. 10, even if it ever occurs.

Figure 13A:
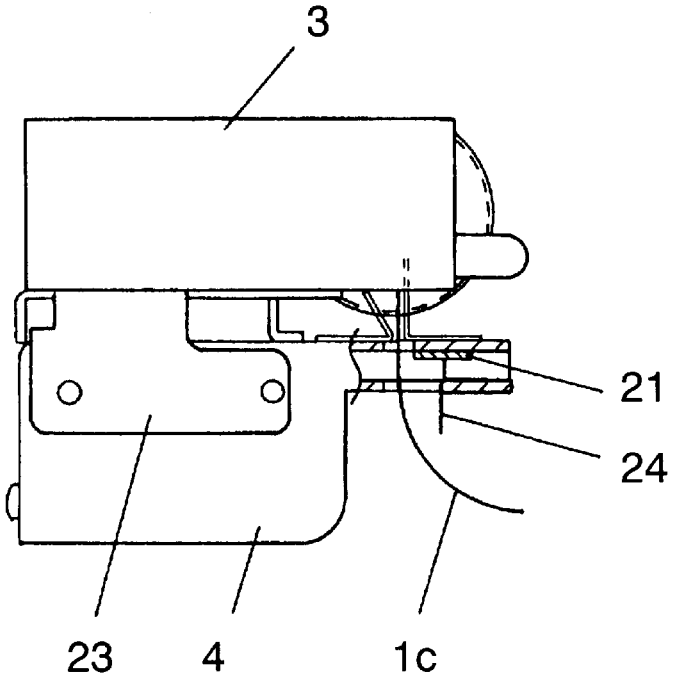
FIG. 13A and FIG. 13B is an enlarged side view depicting a cutter unit of the same exemplary embodiment.
Figure 14:
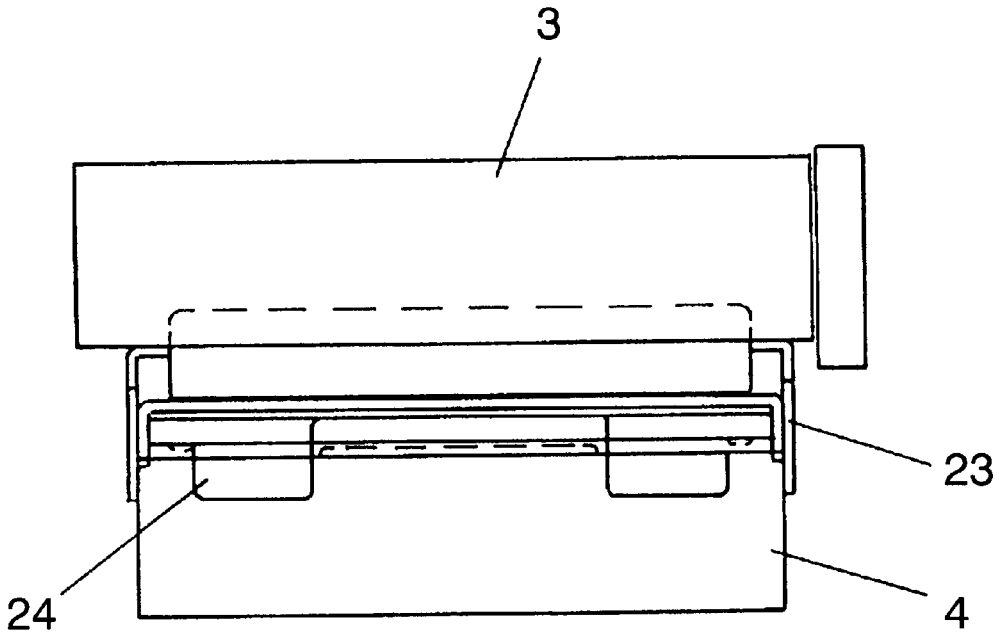
FIG. 14 is an enlarged front view depicting the cutter unit of the same exemplary embodiment.

FIG. 13A depicts an enlarged side view of a cutter unit 4 of the present embodiment, and FIG. 14 depicts an enlarged front view of the cutter unit 4 of the present embodiment. A cutter adapter 23 in the figures is an adapter for mounting the cutter unit 4 onto a printer unit 3. The cutter unit 4 comprises a stationary blade 21 and a movable blade 22 (not shown in FIG. 13A), with which to cut a recording paper 1*c*. A guide 24 is attached to the cutter unit 4 in order to prevent the recording paper 1*c* from being jammed after it is cut.

Figure 13B:
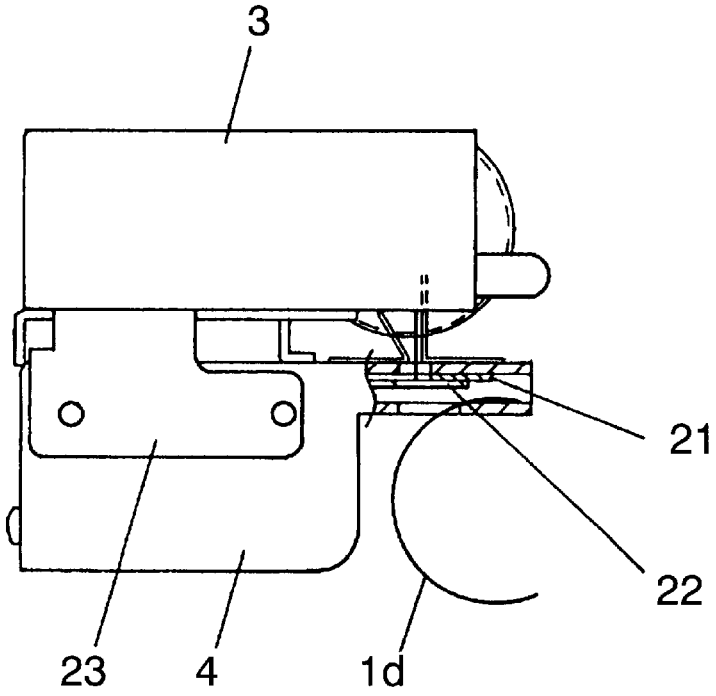
Figure 15:
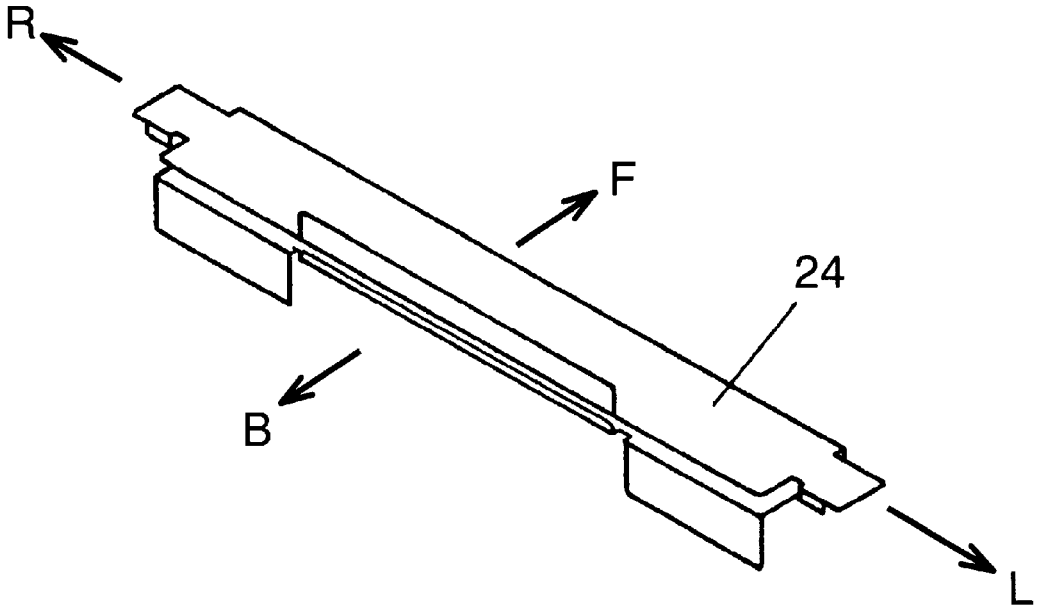
FIG. 15 is a perspective view of a guide unit of the same exemplary embodiment.

The guide 24 is now described by referring to FIG. 13B and FIG. 15. FIG. 13B depicts the structure of FIG. 13A except that the guide 24 is deleted in order to describe a function of the guide 24. FIG. 15 also depicts a perspective view of the guide 24. Letters F, B, R and L in the figure indicate directions of the front, the back, the right side and the left side respectively.

A sheet metal is used for the guide 24 of the present embodiment, but the thickness is not depicted as it is disregarded because of a very thin material.

There is a concern that a cut recording paper 1*d*, which has a vicious curl, can be caught by the cutter unit 4 in a lack of the guide 24, as shown in FIG. 13B, but this is avoidable by adopting the guide 24.

Sixth Exemplary Embodiment

Figure 16:
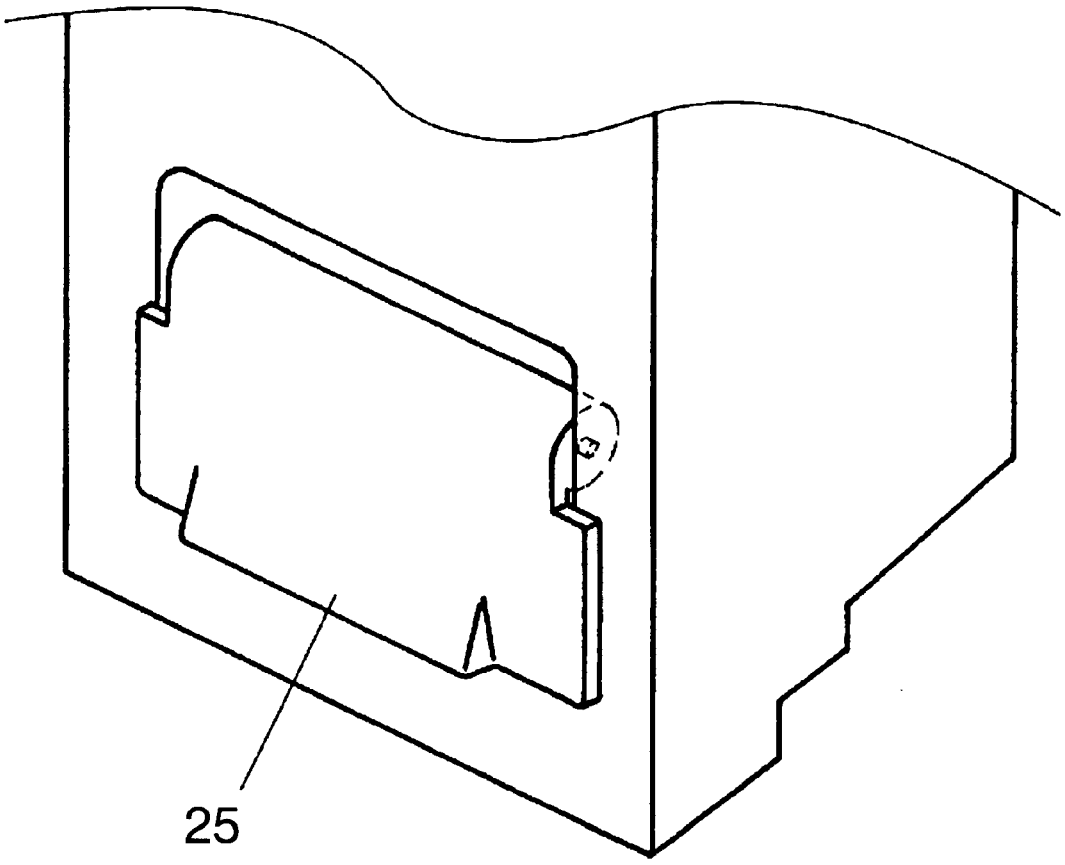
FIG. 16 is a fragmentary perspective view of a discharge port and its vicinity of a printing apparatus of a sixth exemplary embodiment of the present invention.

FIG. 16 is a fragmentary view of a sixth exemplary embodiment of the present invention. This embodiment adopts a cover 25 to a discharge port 6 of the fifth exemplary embodiment. With an adoption of the cover 25, recording papers after having been cut are prevented from flying out, and a printing apparatus is able to effectively avoid rain water and dust from entering into the apparatus even if it is placed outdoors.

Seventh Exemplary Embodiment

An operation of a seventh exemplary embodiment of the present invention is described.

FIG. 17A to FIG. 17D are typical drawings depicting an operational of a printing apparatus of a seventh exemplary embodiment of the present invention. In FIG. 17A to FIG. 17D, numerals 1*c*, 21, 22, 26 and 27 represent a recording paper, a stationary blade, a movable blade, a roller and a printer head, respectively. A normal printing operation is carried out by pressing the recording paper 1*c* against the printer head 27 with the roller 26 in rotary motion during printing while also transferring the paper simultaneously, followed by discharging the paper after it is cut with the stationary blade 21 and the movable blade 22.

Figure 17A:
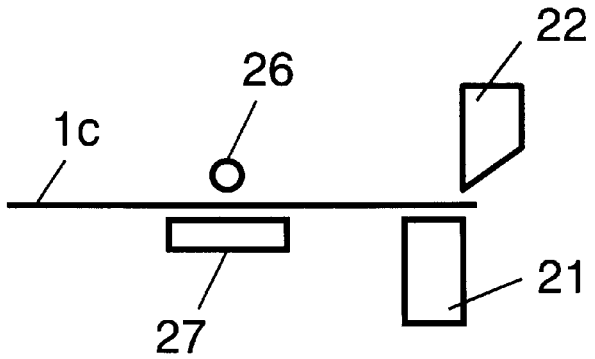
FIG. 17A to FIG. 17D is a typical drawing depicting an operational flow of a printing apparatus of a seventh exemplary embodiment of the present invention.
Figure 17B:
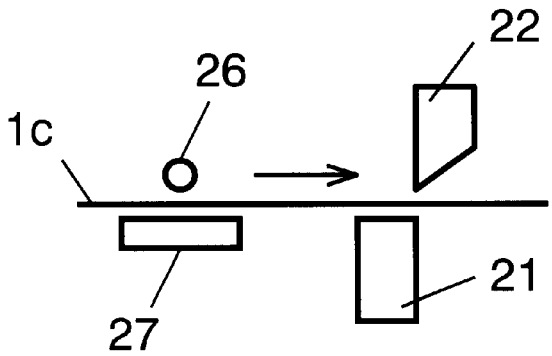
Figure 17C:
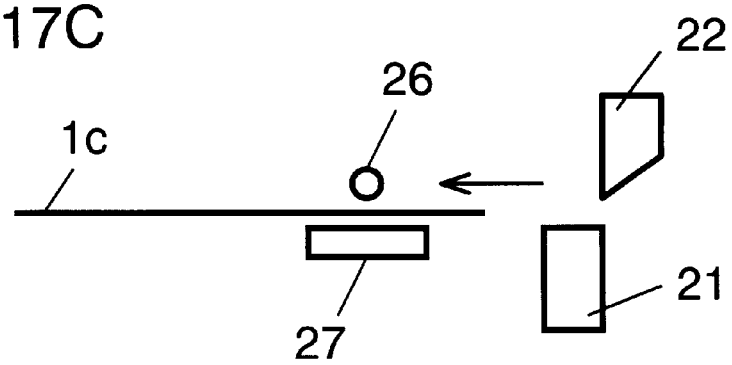
Figure 17D:
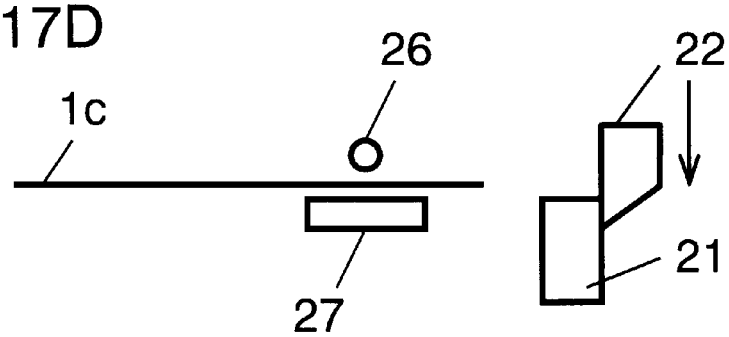

FIG. 17A depicts an initial condition of a stand by period, FIG. 17B depicts a condition wherein the paper 1*c* is transferred in a forward direction after a predetermined time has elapsed during the stand by period, FIG. 17C depicts a condition wherein the paper 1*c* is transferred in a reversed direction, and FIG. 17D depicts a condition wherein an automatic cutter is activated. The recording paper 1*c* is sent forward with a rotation of the roller 26, in FIG. 17B, and the recording paper 1*c* is returned backward with a reversed rotation of the roller 26, in the next FIG. 17C, so as to prevent the recording paper 1*c* from being stuck completely with the printer head 27 or the roller 26 by temporarily freeing the recording paper which begins to stick with them. In FIG. 17D, the movable blade 22 is activated, so as to protect component parts of an automatic cutter mechanism from oxidation, corrosion, hardening of grease, etc.

The operation described above is able to prevent a paper jam caused by a complete stick of the recording paper 1*c*, which is liable to occur in case of a long stand-by period before a succeeding printing operation, or if it is used in an environment of high temperature and high humidity, etc. regardless of the stand-by time.

In the above description, the forward direction is meant to be a direction to which the recording paper 1*c* is transferred during the printing operation, and it is the right side in FIG. 17A to FIG. 17D. The reversed direction is a direction opposite to the forward direction. Also, any spot located in the forward direction and any spot located in the reversed direction with respect to a basic position may be referred to as an upstream side and a downstream side respectively from now on.

Although in the described exemplar operation of the present embodiment, the recording paper 1*c* is once transferred in the forward direction after the predetermined time is elapsed, and it is cut following the transfer to the reversed direction, the same effect is also attainable by transferring the recording paper 1*c* once toward the reversed direction after an elapse of the predetermined time, and transferred to the forward direction after it is cut.

Eighth Exemplary Embodiment

FIG. 18A to FIG. 18D are typical drawings depicting an operational of a printing apparatus of an eighth exemplary embodiment of the present invention. A letter A in the figures indicates a backside of a cutter.

Figure 18A:
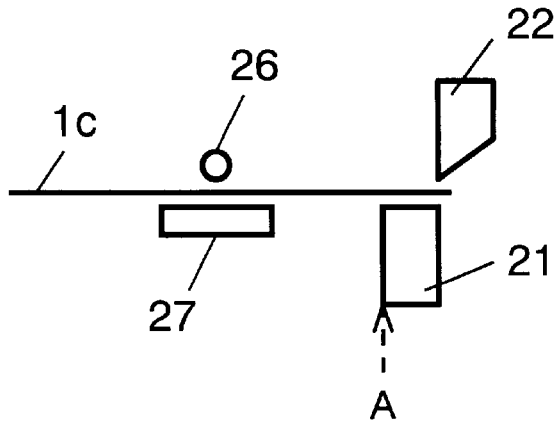
FIG. 18A to FIG. 18D is a typical drawing depicting an operational flow of a printing apparatus of a eighth exemplary embodiment of the present invention.
Figure 18B:
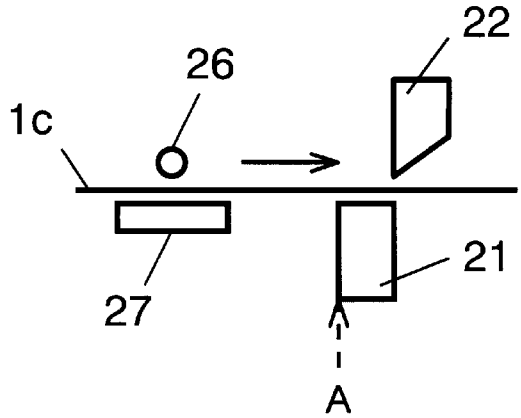
Figure 18C:
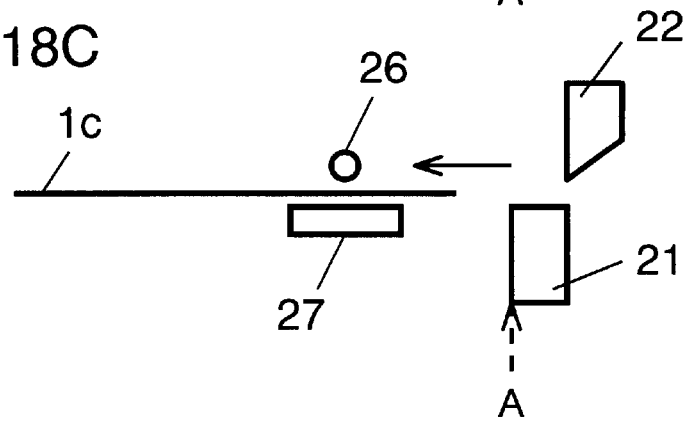
Figure 18D:
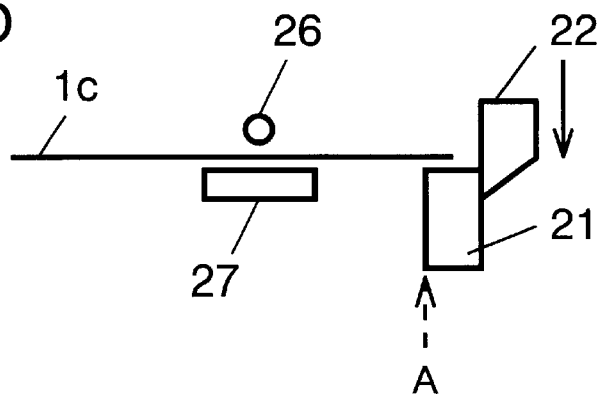

An operation of a eighth exemplary embodiment of the present invention is now described along with FIG. 18A to FIG. 18D. FIG. 18A depicts an initial condition of a stand-by period, FIG. 18B depicts a condition wherein the recording paper 1*c* is transferred in a forward direction after a predetermined time has elapsed during the stand-by period, FIG. 18C depicts a condition wherein the recording paper 1*c* is transferred in a reversed direction and stepped with a leading end of the recording paper 1*c* located at a position downstream of the backside of the cutter, and FIG. 18D depicts a condition wherein an automatic cutter is activated. The recording paper 1*c* is sent forward with a rotation of the roller 26, in FIG. 18B, and the recording paper 1*c* is returned backward with a reversed rotation of the roller 26, to a position where the leading end of the recording paper 1*c* does not exceed the backside of the cutter in the next FIG. 18C, so as to prevent the leading end of the recording paper 1*c* from being cut by a subsequent cutting operation, as well as a paper jam in an insertion port at the backside of the cutter during a paper transferring operation after the cutting.

Hence, paper jams caused by a complete stick as described above can be prevented by temporarily freeing the paper, which begins to stick with the printer head 27 or the roller 26, by rotating the roller 26 forward and backward, in the same manner as the operation of the seventh exemplary embodiment, and also component parts of a paper transfer mechanism and an automatic cutter mechanism can be protected from oxidation, corrosion, hardening of grease, etc.

Ninth Exemplary Embodiment

FIG. 19A to FIG. 19E are typical drawings depicting-an operational of a printing apparatus of a ninth exemplary embodiment of the present invention.

Figure 19A:
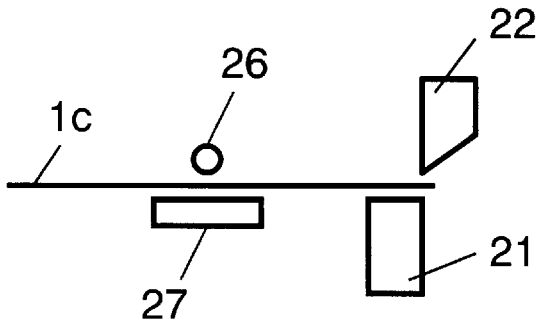
FIG. 19A to FIG. 19E is a typical drawing depicting an operational flow of a printing apparatus of a ninth exemplary embodiment of the present invention.
Figure 19B:
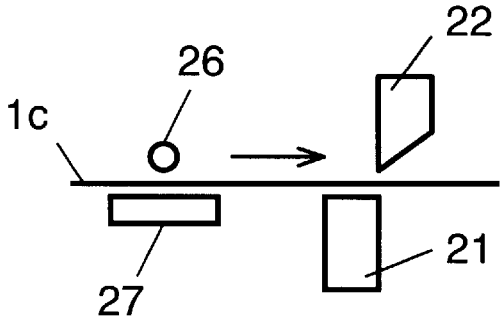
Figure 19C:
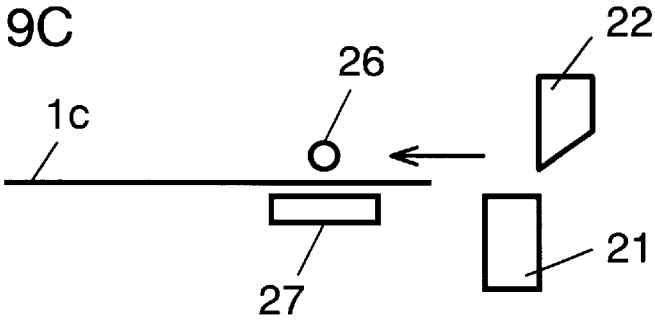
Figure 19D:
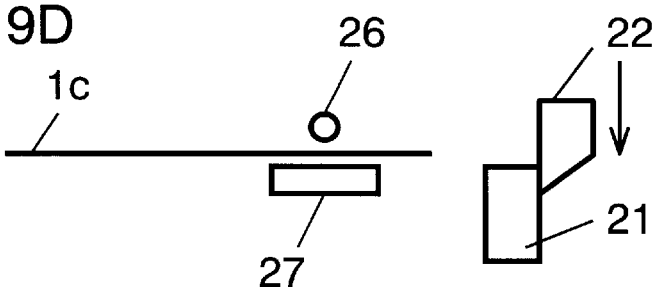
Figure 19E:
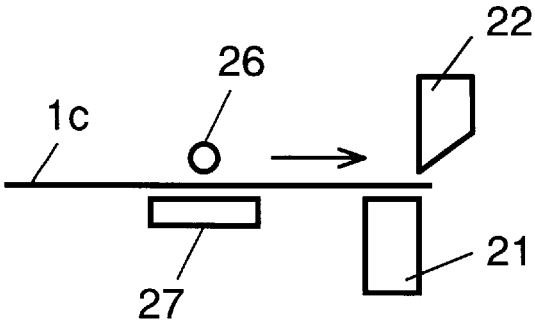

Since FIG. 19A to FIG. 19D depict the same conditions as FIG. 17A to FIG. 17D in the seventh exemplary embodiment of the present invention, they are not described below. FIG. 19E depicts a condition where a recording paper 1*c* is transferred in the forward direction to the initial position (a condition in the start of a stand-by period), and a dispersion in position of the recording paper 1*c* after a series of the above operations can be deprived by transferring it in the forward direction in order to absorb a backlash in gears that constitute the paper transfer mechanism. It also has an effect of preventing paper jams in the same way as the seventh exemplary embodiment, as a matter of course.

Tenth Exemplary Embodiment

Figure 20A:
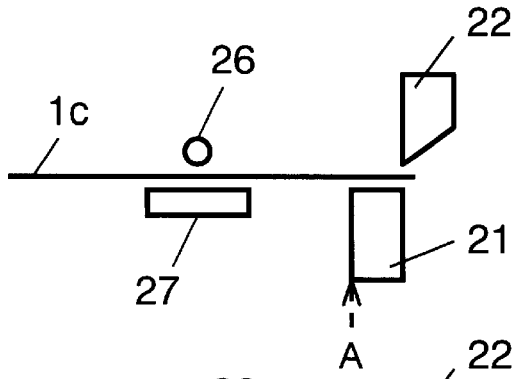
FIG. 20A to FIG. 20E is a typical drawing depicting another exemplar of an operational flow of a printing apparatus of a tenth exemplary embodiment of the present invention.
Figure 20B:
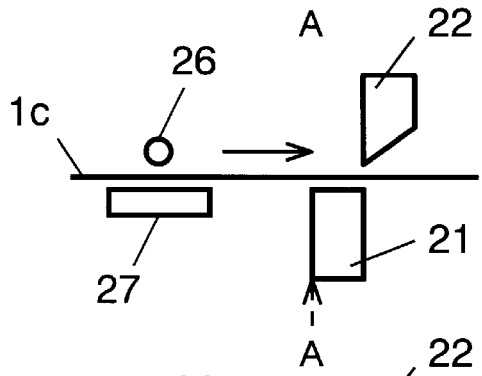
Figure 20C:
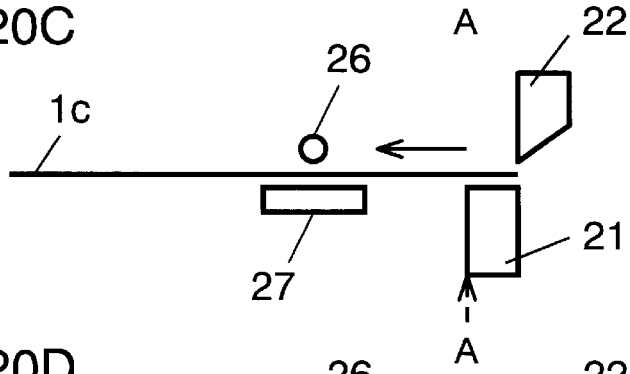
Figure 20D:
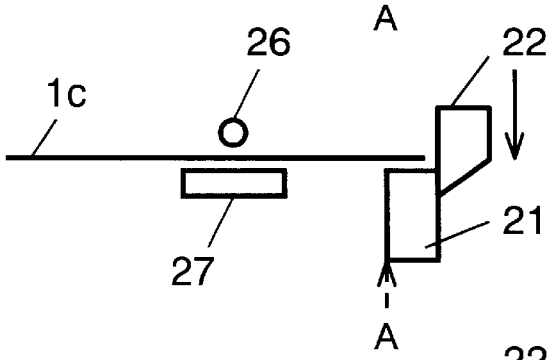
Figure 20E:
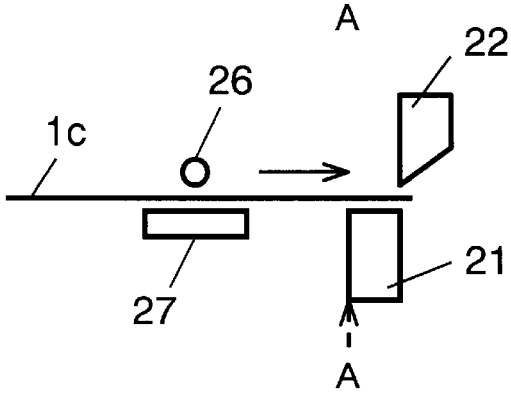

A tenth exemplary embodiment of the present invention is described in the same manner by referring to FIG. 20A to FIG. 20E. Since FIG. 20A to FIG. 20D depict the same conditions as FIG. 18A to FIG. 18D in the eighth exemplary embodiment of the present invention, they are not described below. FIG. 20E depicts a condition where a recording paper 1*c* is transferred in the forward direction to the initial position (a condition in the start of a stand-by period), and a dispersion in position of the recording paper 1*c* after a series of the above operations can be decreased by transferring it in the forward direction in order to absorb a backlash in gears that constitute the paper transfer mechanism. As a matter of course, it also has an effect of preventing paper jams in the same way as the eighth exemplary embodiment.

Eleventh Exemplary Embodiment

Figure 21A:
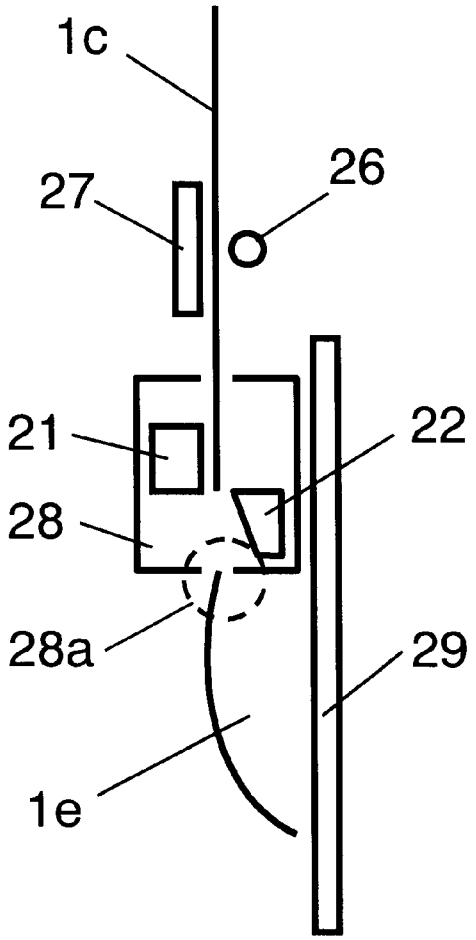
FIG. 21A and FIG. 21B is a typical drawing depicting an operational flow of a printing apparatus of a eleventh exemplary embodiment of the present invention.
Figure 21B:
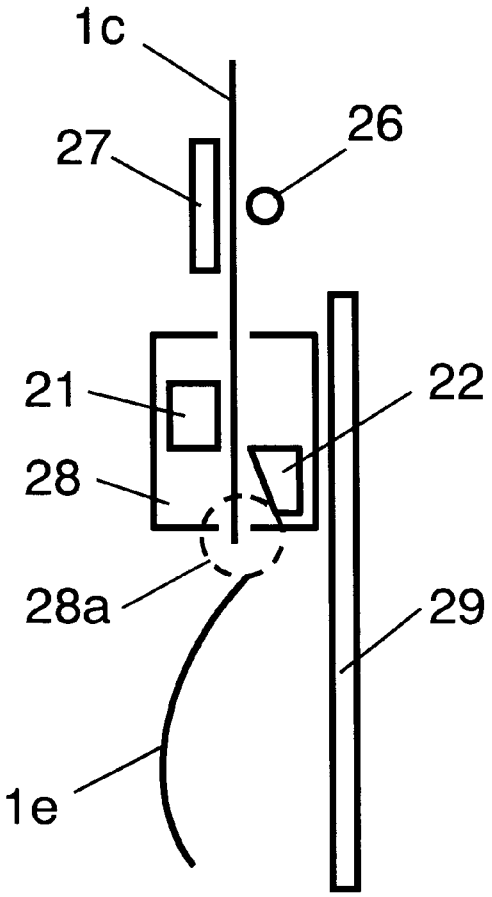

FIG. 21A and FIG. 21B are typical drawings depicting an operational of a printing apparatus of an eleventh exemplary embodiment of the present invention.

In FIG. 21A and FIG. 21B, the same component elements as those of FIG. 17A to FIG. 17D are assigned with the same reference numerals, and their descriptions are omitted. Numerals 28, 28*a* and 29 represent a cutter housing, a paper exit of the cutter housing 28 and a paper discharge guide, respectively.

FIG. 21A depicts an initial condition of a stand-by period, in which a slightly curled recording paper 1*c* is hanging by adhesion on the paper exit 28*a* of the cutter housing 28 after having been cut, and FIG. 21B depicts a condition where a paper advancing operation has been made after a predetermined time interval during the standby period after the cutting. The paper advancing operation after lapse of the predetermined time has a function of pushing out the adhering paper 1*e*. Accordingly, a printed recording paper after having been cut can be discharged, even if it is jammed within the apparatus.

Twelfth Exemplary Embodiment

Figure 22:
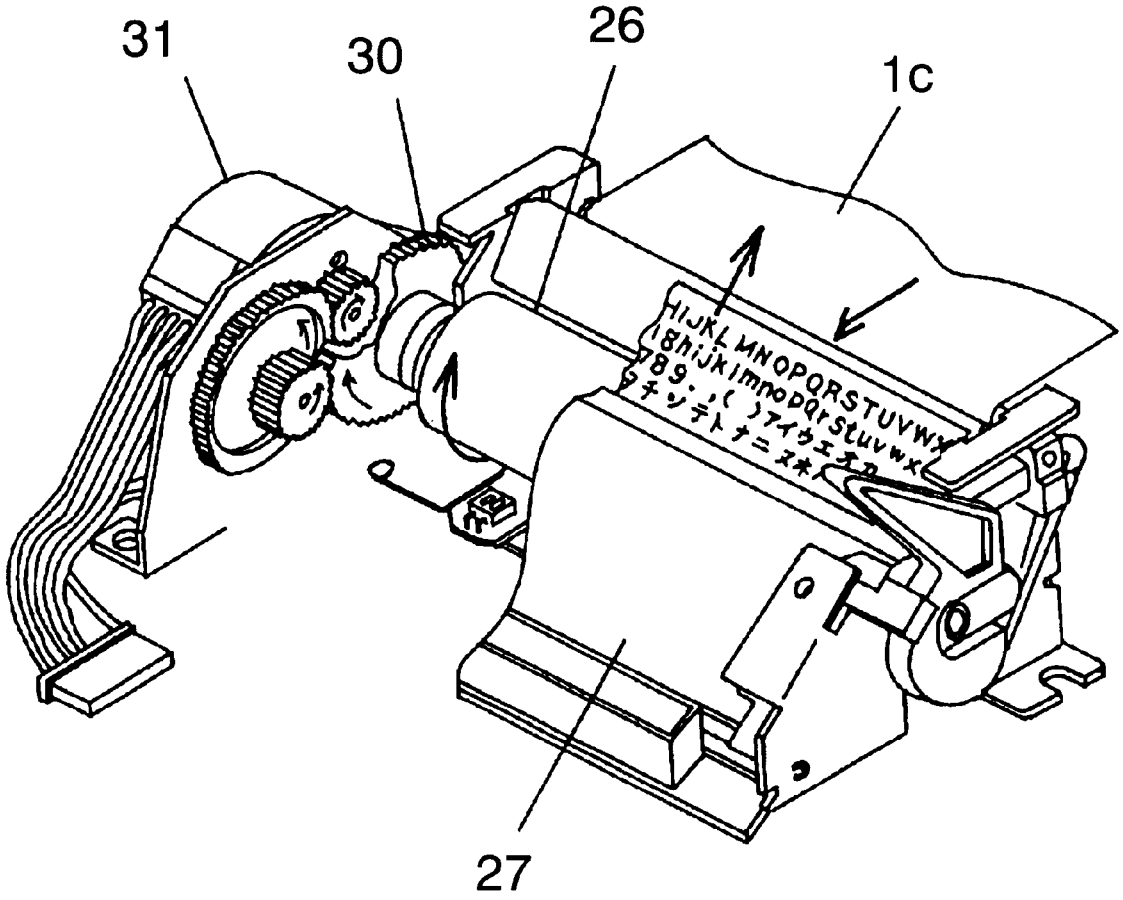
FIG. 22 is a perspective view depicting a construction of a printing apparatus of a twelfth exemplary embodiment of the present invention.

FIG. 22 is a perspective view depicting a structure of a printing apparatus of a twelfth exemplary embodiment of the present invention, in which a numeral 1*c* is a recording paper, a numeral 27 is a printer head for printing characters or figures on the recording paper 1*c*, a numeral 26 is a roller for transferring the recording paper by making a contact with the printer head 27, a numeral 31 is a stepping motor for rotating the roller 26, and a numeral 30 is a paper transfer gear for transferring rotary motion of the stepping motor 31 to the roller 26. The roller 26, the stepping motor 31 and the paper transfer gear 30 constitute a transfer means.

Figure 23:
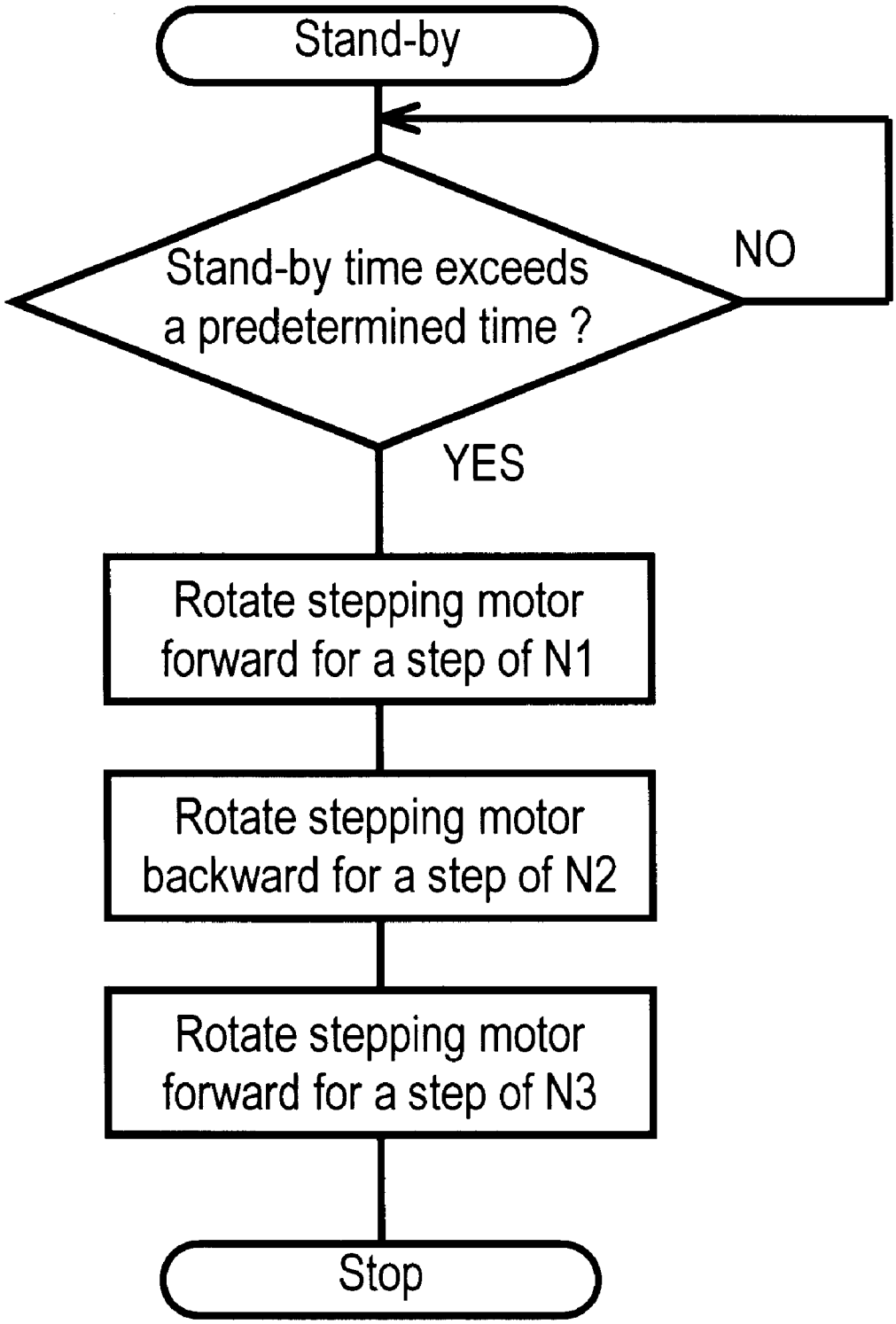
FIG. 23 is an operational flowchart during a stand-by period in the twelfth exemplary embodiment of the present invention.

FIG. 23 is an operational flowchart during a stand-by period in the same exemplary embodiment.

An operation of the twelfth exemplary embodiment is described by referring to FIG. 22 and FIG. 23.

When the printing apparatus is placed in a stand-by position, it waits for a predetermined time, and rotates the stepping motor 31 in the forward direction for a step of "N1" when the predetermined time has elapsed, in order to transfer the recording paper 1*c* in the forward direction. It then rotates the stepping motor 31 in the reversed direction for a step of "N2" to transfer the paper 1*c* in the backward direction. Finally, it rotates the stepping motor 31 in the forward direction for a step of "N3" to transfer the recording paper 1*c* in the forward direction before terminating the stand-by operation. In here, the forward direction is meant to be a direction shown by an arrow in FIG. 22, and the reversed direction is a direction opposite to it.

The printing apparatus derived as above transfers the recording paper in the forward and the reversed directions in every predetermined interval during the stand-by period, and prevents the recording paper 1*c* from being stuck completely with the printer head 27 or the roller 26 by temporarily freeing the paper that begins to stick, so as to avoid a paper jam caused by an adhesion and to prevent grease used for the components constituting the paper transfer mechanism from hardening. The printing apparatus also provides an effect of avoiding disfigurement of characters in a beginning of the subsequent printing, since it absorbs a backlash that occurs in the paper transfer gear 30, by rotating the stepping motor 31 in the forward direction, in the reversed direction, and again in the forward direction.

In this exemplar operation of the present embodiment, although the stepping motor is rotated in the reversed direction again after having rotated in the forward direction when the predetermined time has elapsed during the stand-by period, the same effect is also attainable by rotating the stepping motor first in the reversed direction and in the forward direction thereafter. Also, a D.C. motor can be utilized in place of the stepping motor 31, as it is capable of performing the same function in combination with an encoder. Moreover, the recording paper may be transferred by providing a roller for transferring paper in addition to the roller 26, and delivering it with driving force of the motor. These variations are also applicable to a thirteenth and a fourteenth exemplary embodiments described.

Thirteenth Exemplary Embodiment

Figure 24:
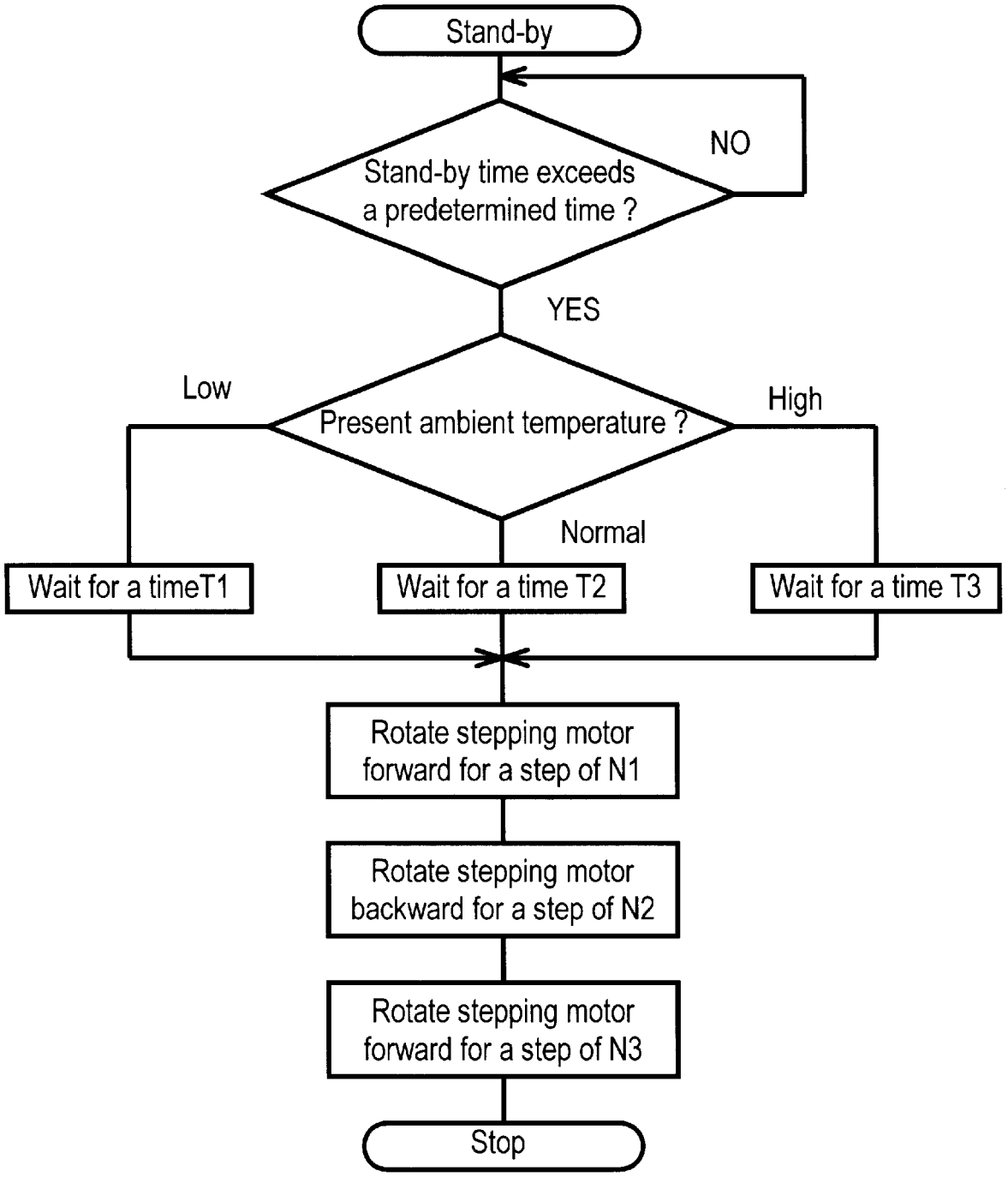
FIG. 24 is an operational flowchart during a stand-by period in a thirteenth exemplary embodiment of the present invention.

FIG. 24 is an operational flowchart during a stand-by period in a thirteenth exemplary embodiment. A structure of the present embodiment is identical to that of the twelfth exemplary embodiment, which is shown in FIG. 22.

In the present embodiment, when a printing apparatus is placed in a stand-by position, it waits for lapse of a predetermined time, takes a measurement of a latest ambient temperature after the predetermined time has elapsed, and adjusts a further waiting time according to the temperature. For instance, it waits for a time of "T1" if the measured temperature is low, waits for a time of "T2" if it is normal, and waits for a time of "T3" if it is high. After that, it rotates a stepping motor 31 forward for a step of "N1" to transfer a recording paper 1*c* in the forward direction. It then rotates the stepping motor 31 backward for a step of "N2" to transfer the recording paper 1*c* in the reversed direction. Finally, it rotates the stepping motor 31 forward for a step of "N3" to transfer the recording paper 1*c* in the forward direction, and, terminates the stand-by operation.

The printing apparatus derived as described above reduces electric power it consume in driving the stepping motor 31 for the stand-by operation, and minimizes a trace that is left behind on a surface of the recording paper 1*c* due to a friction between the printer head 27 and the recording paper 1*c* with the forward and the backward rotations of the stepping motor 31, by reducing a number of operations of the stepping motor 31 with an increase of the time of "T2", since it takes a longer time for the recording paper 1*c* to stick with the printing head 27 or the roller 26 when the ambient temperature is normal. The printing apparatus also has an effect of avoiding a paper jam caused by an adhesion and preventing grease used for the components constituting the paper transfer mechanism from hardening, as it prevents the recording paper 1*c* from being stuck completely with the printer head 27 or the roller 26 by temporarily freeing the paper that begins to stick, by increasing a number of operations of the stepping motor 31 with a decrease of the time of "T1" and "T2", since it takes relatively a shorter time for the recording paper 1*c* to stick with the printing head 27 or the roller 26 when the ambient temperature is either low or high.

Although a determination of the ambient temperature is made for the three levels of low, normal and high, in this exemplar operation of the present embodiment, a better effect can be achieved if it is further divided into more levels.

Fourteenth Exemplary Embodiment

Figure 25:
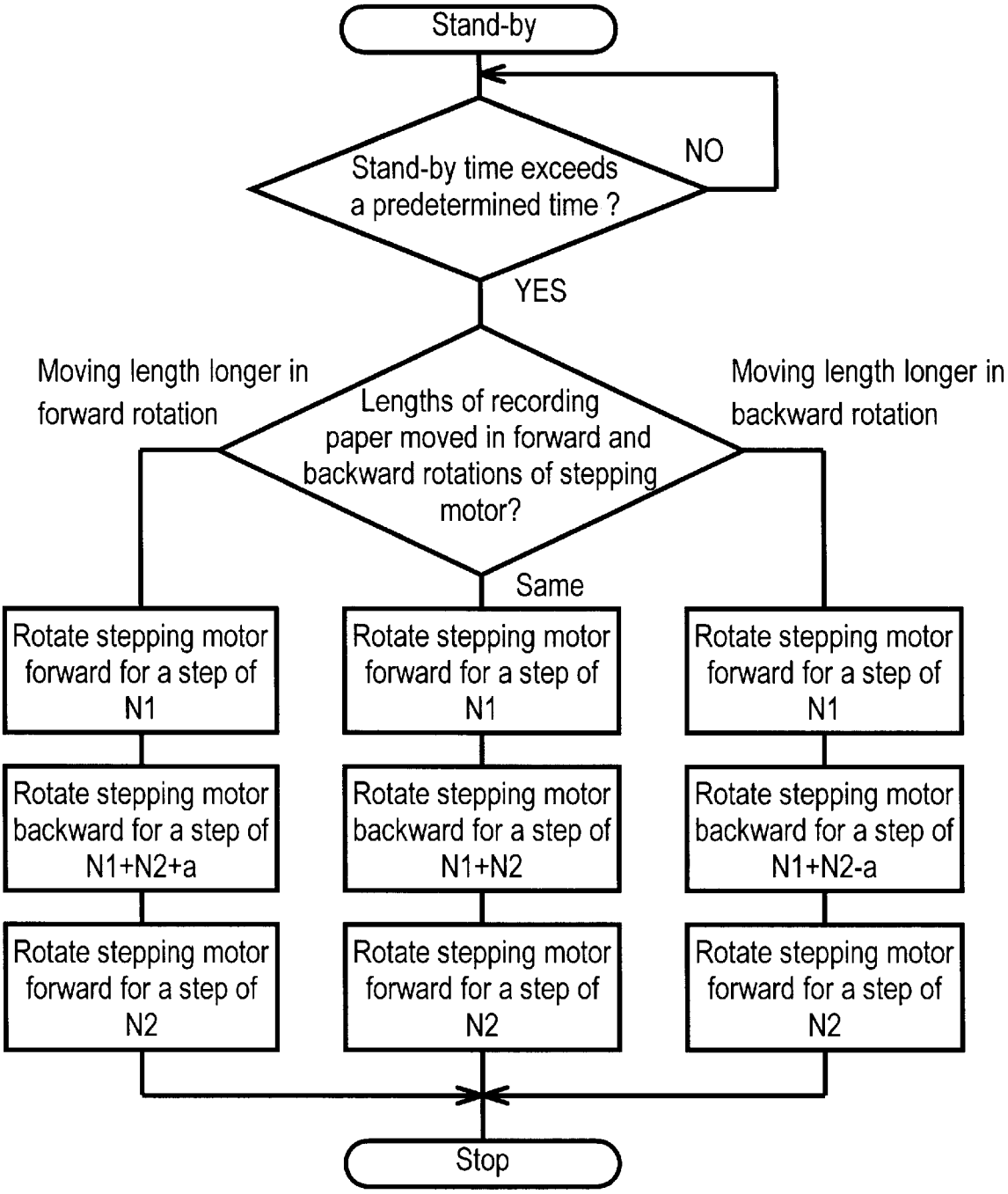
FIG. 25 is an operational flowchart during a stand-by period in a fourteenth exemplary embodiment of the present invention.
Figure 26:
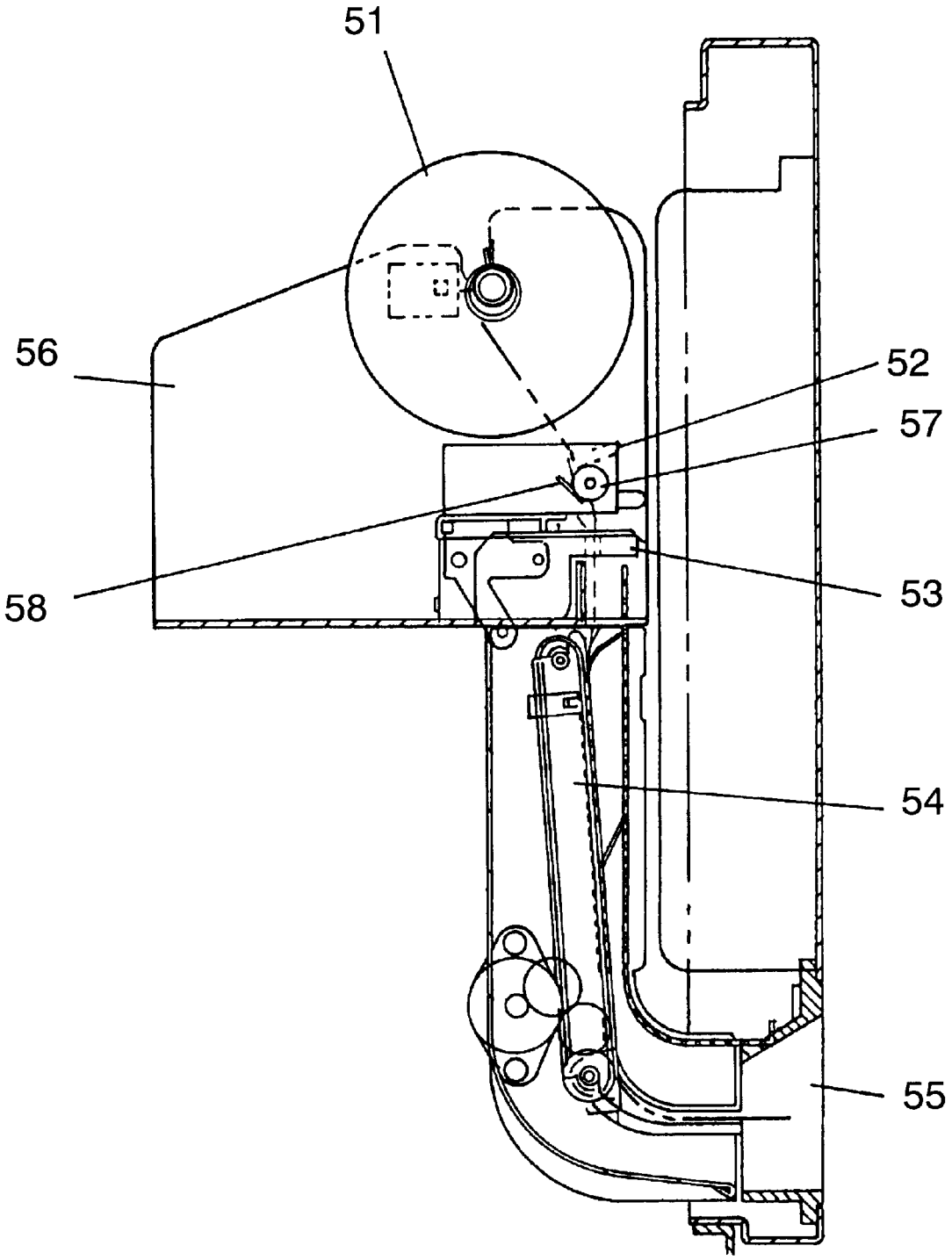
FIG. 26 is a structural drawing depicting a printing apparatus of the prior art.

FIG. 25 is an operational flowchart during a stand-by period in a fourteenth exemplary embodiment. A structure of the present embodiment is identical to that of the twelfth exemplary embodiment, which is shown in FIG. 22.

When a printing apparatus is placed in a stand-by position, it waits for lapse of a predetermined time, and, after the predetermined time has elapsed, it proceeds into any one of processes A, B or C, according to a previously memorized information of dispersion in a magnitude of movement of the recording paper 1*c* when the stepping motor 31 has rotated forward and backward. A magnitude of movement of the recording paper 1*c* disperses when the stepping motor 31 rotates forward and backward, because there are cases in which the recording paper 1*c* moves a different magnitude due to a variation in condition of finish of a roller 26 and a load on a transfer system of the recording paper 1*c*, even if a number of forward steps and a number of reversed steps of the stepping motor 31 are same, and there are three cases of them, i.e., a magnitude of movement is larger in the forward rotation, a magnitude of movement is larger in the backward rotation, and, magnitude of movements are same between the forward and the backward rotations.

If a magnitude of movement of the recording paper 1*c* is larger in the forward rotation than in the backward rotation, the stepping motor 31 is rotated forward for a step of "N1", followed by backward rotation for a step of "N1+N2+a", followed finally by forward rotation for a step of "N2". A magnitude represented by the letter "a" corresponds to dispersion in the movement of the recording paper 1*c* by the forward and the backward rotations of the stepping motor 31.

Also, if magnitude of movements of the recording paper 1*c* are same in the forward rotation and in the backward rotation, the stepping motor 31 is rotated forward for a step of "N1", followed by backward rotation for a step of "N1+N2", followed finally by forward rotation for a step of "N2".

Also if a magnitude of movement of the recording paper 1*c* is larger in the backward rotation than in the forward rotation, the stepping motor 31 is rotated forward for a step of "N1", followed by backward rotation for a step of "N1+N2−a", followed finally by forward rotation for a step of "N2", and the stand-by operation is terminated The printing apparatus derived as described above provides an effect of preventing a paper jam due to adhesion of the recording paper, and avoids shifting of a starting position of printing in the subsequent printing operation after resumption from the stand-by state by moving the recording paper to its original position by varying a number of steps for the forward and backward rotations depending on a condition of finish of the roller and a load on the transfer system of the paper, when rotating the stepping motor 31 forward, backward and forward after lapse of a predetermined time during a stand-by period.

As has been described with the exemplars in the first through the fourteenth embodiments, the printing apparatus of the present invention is provided with: easy replacement of a rolled paper; a guide unit openable from a cutter unit to a discharge port; a structure without a transfer means by enabling it to prevent a cut recording paper from flying out of the discharge port; an operation for preventing adhesion of the recording paper to a printing head or to a roller; and, prevention of a paper jam by thrusting out the recording paper stuck to the cutter unit; in addition to other effects as described in the individual exemplary embodiments.

As has been described, the present invention is able to realize a printing apparatus of a small size for which replacement of a rolled paper and removal of a jammed paper can be carried out easily with a considerably simple structure, and to provide the printing apparatus of a small size with a considerably simple structure that can reliably deliver a printed output of even an irregular shape (varied in length) to a discharge port while alleviating likeliness of a paper jam.

Furthermore, the present invention is able to realize a highly reliable printing apparatus of a small size, which alleviates a paper jam in a succeeding printing operation, and avoids an impairment to operation of a paper transfer mechanism and a cutter mechanism, even when a stand-by state continues for an extended time period, and under such severe environmental conditions as high temperature and high humidity, or low temperature and low humidity, etc.

Accordingly, the printing apparatus is fit for not only household use, but also business use that requires a high reliability, and it is also suitable as a printing apparatus for outdoor use since it has a structure protected well against rain, etc., and adaptable to changes of an ambient temperature.

Reference Numerals

1 Rolled paper
1*a* to 1*e* Recording paper
2 Rolled-paper holder
3 Printer unit
4 Cutter unit
5 Guide unit
5*a* First guide member
5*b* Second guide member
6 Discharge port
7 Roller-paper thruster
8 Controller
9 Roller shaft
10 Cover
10*a* Axis
11 Movable rolled-paper holder
12 Frame
13 Shaft
14 Rolled-paper holder
15 L-shaped guide unit
15A End part
16 Discharge port
17 Chain link (Projection)
17*a* Hole
18 Stopper
19 Rib of a triangular shape
20 Rib
21 Stationary blade
22 Movable blade
23 Cutter adapter
24 Guide
25 Cover
26 Roller
27 Printer head
28 Cutter housing
28*a* Paper exit
29 Paper discharge guide
30 Paper transfer gear
31 Stepping motor Nov. 19, 1998 曾我氏納入(E 曾我).
Nov. 19–21, 1998 檢討修正(E1).

What is claimed is:

1. A printing apparatus comprising:

a main body;

a duct shaped guide unit comprising at least two guide unit parts for guiding a printed recording paper; and a cover openably attached to said main body for covering at least a part of said main body;

wherein one of said guide unit parts is attached to said cover and an other one of said guide unit parts is attached to said main body such that closing said cover configures said guide unit in the shape of a duct.

2. The printing apparatus according to claim 1, wherein rolled paper is held in said main body in a direction such that printed recording paper is curled toward said cover when discharged, and said one of said guide unit parts attached to said cover has a low surface roughness.

3. The printing apparatus according to claim 2, wherein said one of said guide unit parts attached to said cover is constructed of an electrically conductive material.

4. A printing device comprising:

a printer unit for printing on rolled paper, a cutter unit for cutting the rolled paper according to a printed length, a discharge port for discharging cut rolled paper, and an L-shaped guide unit for guiding the cut rolled paper to fall under its own weight toward said discharge port, wherein said discharge port is provided with a stopper for preventing said cut rolled paper from flying out of said discharge port.

5. The printing apparatus according to claim 4, wherein said discharge port is provided with an openable cover.

6. The printing device according to claim 4, wherein a projection constructed of a cord-like member or a stick-shaped member is provided on a ceiling part deep inside of an opening of said L-shaped guide unit.

7. The printing apparatus according to claim 4, wherein a bottom surface of said L-shaped guide unit is inclined toward said discharge port, and said bottom surface is provided with a water drainage at a lowermost position thereof.

8. The printing apparatus according to claim 4, wherein a bottom surface of said L-shaped guide unit is provided with a plurality of ribs extending in a paper discharge direction, said ribs having tips that are convex and asymmetrical.

9. The printing apparatus according to claim 4, wherein a vertical back wall surface of said L-shaped guide unit is provided with a plurality of ribs extending in a direction generally perpendicular to a paper discharge direction, tip ends of said ribs being sloped toward a bottom side of said L-shaped guide unit.

10. The printing apparatus according to claim 9, wherein all of said ribs are laterally inclined from an approximate center of said back wall surface in a breadth direction.

11. The printing apparatus according to claim 6, wherein said projection comprises a plurality of protruding members.

12. A printing device comprising:

a printer unit for printing on rolled paper, a cutter unit for cutting the rolled paper according to a printed length, a discharge port for discharging cut rolled paper, means for guiding the cut rolled paper falling under its own weight toward said discharge port, and means for preventing said cut rolled paper from flying out of said discharge port.

13. The printing apparatus according to claim 12, wherein said discharge port is provided with an openable cover.

14. The printing device according to claim 12, wherein said means for guiding comprises an opening having a projection constructed of a cord-like member or a stick-shaped member provided on a ceiling part deep inside of said opening the.

15. The printing apparatus according to claim 14, wherein said projection comprises a plurality of protruding members.

16. The printing apparatus according to claim 12, wherein said means for guiding comprises a bottom surface inclined toward said discharge port, and said bottom surface having a water drain located at a lowermost point thereof.

17. The printing apparatus according to claim 12, wherein a bottom surface of said means for guiding is provided with a plurality of ribs extending in a paper discharge direction, said ribs having tips that are convex and asymmetrical.

18. The printing apparatus according to claim 12, wherein a vertical back wall surface of said means for guiding is provided with a plurality of ribs extending in a direction generally perpendicular to a paper discharge direction, tip ends of said ribs being sloped toward a bottom side of said means for guiding.

19. The printing apparatus according to claim 18, wherein all of said ribs are laterally inclined from an approximate center of said back wall surface in a breadth direction.

20. A printing apparatus comprising:

a main body having a printing work position for carrying out printing on rolled paper and a paper setting position for setting the rolled paper;

a rolled-paper holder mounted rotatably on said main body and having a first holding position for carrying out printing on the rolled paper and a second holding position for having the rolled paper set on said rolled-paper holder;

wherein said rolled-paper holder is movable to said second position when said main body is in said paper setting position, and a duct shaped guide unit including a discharge port and a holder for the rolled paper, the rolled paper having a roll shaft, wherein the rolled paper is detachable from the roll shaft.

21. The printing apparatus according to claim 20, wherein:

said duct shaped guide unit comprises at least two guide unit parts for guiding a printed recording paper; and a cover is openably attached to said main body for covering at least a part of said main body;

wherein one of said guide unit parts is attached to said cover and an other one of said guide unit parts is attached to said main body such that closing said cover configures said guide unit in the shape of a duct.

22. The printing apparatus according to claim 21, wherein the rolled paper is held in said main body in a direction such that printed recording paper is curled toward said cover when discharged, and said one of said guide unit parts attached to said cover has a low surface roughness.

23. The printing apparatus according to claim 22, wherein said one of said guide unit parts attached to said cover is constructed of an electrically conductive material.

24. A printing apparatus comprising:

a main body having a printing work position for carrying out printing on a rolled paper with a roll shaft and a paper setting position for setting the rolled paper with the roll shaft, wherein the rolled paper is detachable from the roll shaft;

wherein the rolled paper with the roll shaft is movable between the printing work position for carrying out printing on the rolled paper with the roll shaft and the paper setting position for setting the rolled paper with the roll shaft;

a duct shaped guide unit for guiding paper from the rolled paper;

means for automatically cutting the rolled paper and discharging the paper downward along said duct shaped guide unit after printing so as to form a cut paper printed side of the paper for discharge and an uncut and unprinted side of the paper which has not yet been printed on, and means for transferring the uncut and unprinted side of the paper further in a forward direction in order to prevent the cut paper printed side from being jammed in said duct shaped guide unit.

* * * * *